US007353975B2

(12) United States Patent
Haramiishi et al.

(10) Patent No.: US 7,353,975 B2
(45) Date of Patent: Apr. 8, 2008

(54) STAPLER

(75) Inventors: Kiichi Haramiishi, Tokyo (JP); Katsunori Manabe, Tokyo (JP)

(73) Assignee: Max Kabushiki Kaisha, Chuo-Ku, Tokyo (JP)

( * ) Notice: Subject to any disclaimer, the term of this patent is extended or adjusted under 35 U.S.C. 154(b) by 107 days.

(21) Appl. No.: 10/545,224

(22) PCT Filed: Feb. 16, 2004

(86) PCT No.: PCT/JP2004/001654

§ 371 (c)(1),
(2), (4) Date: Aug. 12, 2005

(87) PCT Pub. No.: WO2004/071727

PCT Pub. Date: Aug. 26, 2004

(65) Prior Publication Data

US 2006/0054654 A1 Mar. 16, 2006

(30) Foreign Application Priority Data

Feb. 14, 2003 (JP) ..... 2003-037516

(51) Int. Cl.
*B27F 7/38* (2006.01)

(52) U.S. Cl. ..... 227/120; 227/135; 227/136; 227/119; 206/340

(58) Field of Classification Search ..... 227/120, 227/135, 136, 119; 206/340
See application file for complete search history.

(56) References Cited

U.S. PATENT DOCUMENTS 3,224,657 A * 12/1965 Zike ..... 227/88
5,501,387 A 3/1996 Yoshie
6,050,471 A * 4/2000 Yagi ..... 227/119
6,371,352 B1 * 4/2002 Mochizuki ..... 227/155
6,568,579 B2 5/2003 Mochizuki
6,616,027 B2 * 9/2003 Mochizuki ..... 227/131
6,899,258 B2 * 5/2005 Haramiishi ..... 227/2

(Continued)

FOREIGN PATENT DOCUMENTS

JP 6-210578 8/1994

(Continued)

*Primary Examiner*—Rinaldi I. Rada
*Assistant Examiner*—Michelle Lopez
(74) *Attorney, Agent, or Firm*—Buchanan Ingersoll & Rooney PC

(57) ABSTRACT

There is provided a stapler in which a cartridge can be mounted on a stapler body in a stable manner without wobbling, and fixing of the cartridge can be released in synchronization with opening operation of a door member. A stapler has a cartridge which is provided in a cartridge holding chamber of the stapler body in such a way that the cartridge can be pulled out from the cartridge holding chamber, and a locking shaft biased upward by an elastic member is provided in the lower portion of an opening in the cartridge holding chamber. The cartridge has a locking projection and a door member. When the cartridge is pushed into the cartridge holding chamber and held therein, the locking projection is locked with the above-described locking shaft, and, furthermore, the door member is biased in such a way that the opening of the cartridge holding chamber is closed by the above-described locking shaft. When the door member is opened, the locking shaft can be detached from the locking projection by the door member.

5 Claims, 18 Drawing Sheets

U.S. PATENT DOCUMENTS

| | | | | |
|---|---|---|---|---|
| 7,014,084 | B2 * | 3/2006 | Mochizuki et al. | 227/1 |
| 2004/0188492 | A1 * | 9/2004 | Haramiishi | 227/131 |
| 2004/0245307 | A1 * | 12/2004 | Haramiishi | 227/4 |
| 2006/0144890 | A1 * | 7/2006 | Haramiishi et al. | 227/120 |

FOREIGN PATENT DOCUMENTS

| | | |
|---|---|---|
| JP | 2001-347472 | 12/2001 |
| JP | 2003-145505 | 5/2003 |

* cited by examiner (b)

(a)

(b)

(a)

(a)

(b)

(a)

(b)

(c)

(a)

(b)

STAPLER

This disclosure is based upon Japanese Application No. 2003-037516, filed Feb. 14, 2003, and International Application No. PCT/JP2004/001654, filed Feb. 16, 2004, the contents of which are incorporated herein by reference.

TECHNICAL FIELD

The present invention relates to a stapler comprising a stapler body and a cartridge which accommodates a refill for staples, and is mounted on a cartridge holding chamber of the stapler body in such a way that the cartridge can be pulled out of the cartridge holding chamber.

BACKGROUND ART

A conventional staple has been used in a state in which a cartridge is mounted on a stapler body in a detachable manner, the cartridge is removed from the stapler body, the cartridge accommodates a refill for staples, and the cartridge accommodating the refill for staples is mounted on the stapler body.

In the conventional stapler, the cartridge has been required to be installed in the stapler body without wobbling in a stable manner by fixing the cartridge in the stapler body through press fitting, using the elasticity of a plastic material in the stapler body, the elasticity of a spring, or the like. However, there has been a problem that the cartridge is unstably mounted on the staple body in some cases because poor setting of the cartridge caused by components with an accuracy of near a tolerance limit for press fitting, poor holding of the cartridge caused by a shortage of the spring elasticity, and the like are generated. Though it is considered as a method for solving the above problem that the cartridge is fixed by a wedged, a complex configuration such as a link is required in a process for pulling out the wedge to make the manufacturing cost higher, and to cause worsened manufacturing efficiency by an added process for drawing the wedge.

A traditional stapler has been used in a state in which a cartridge is removed from a stapler body in order to exchange a refill for staples, and the cartridge accommodates a new refill for staples and is mounted on the stapler body. However, it is considered that the cartridge is dropped by mistake and is broken when the refill for staples is exchanged. Moreover, there has been an inconvenience that the above exchanging is required to be performed with both hands, that is, can not be realized with a single hand. Furthermore, there has been a problem that confusion is created for the jam processing section because the cartridge is provided with a face plate for jam processing at hand, and, when a refill for staple is exchanged, a jam processing section is removed for the exchanging.

Moreover, a conventional stapler has a configuration in which, when the refill for staples is imperfectly accommodated in the cartridge, a needle-less sensor works to warn setting failure. However, there has been a problem that the above configuration gives only the above-described warning, and can not prevent the setting failure beforehand.

The present invention has been made, considering the above problems, and its first object is to provide a stapler in which a cartridge is mounted on a stapler body in a stable manner without wobbling, fixing of the cartridge can be released in synchronization with opening operation of a door member, a complex configuration is not required, cheap manufacturing is realized, a refill for staples can be exchanged by pulling out the cartridge from the stapler body, dropping of the cartridge is prevented, and the exchanging operation can be performed with a single hand. Moreover, its second object is to provide a stapler in which a cartridge which is mounted on a stapler body in such a way that the cartridge can be pulled out from the staple body can be removed from the stapler body, and the cartridge itself can be exchanged. Furthermore, its third object is to provide a stapler in which are fill for staples is automatically accommodated in the cartridge when a cartridge is pushed into and mounted on a stapler body, and the refill for staples can be prevented from poor setting.

DISCLOSURE OF THE INVENTION

In order to achieve the above-described first object, a stapler according to a first aspect of the present invention comprises: a stapler body; and a cartridge which is mounted on a cartridge holding chamber of a stapler body in such a way that the cartridge can be pulled but from the cartridge holding chamber, wherein a locking shaft biased upward by an elastic member is provided in the lower portion of an opening of the cartridge holding chamber, the cartridge has a locking projection and a door member, when the cartridge is mounted on the cartridge holding chamber, the locking projection is locked with the locking shaft and the door member is biased in such a way that the opening of the cartridge holding chamber is closed by the locking shaft, and, when the door member closing the opening of the cartridge holding chamber is opened, the locking shaft is gotten out of the locking projection by the door member.

In order to achieve the above-described first object, the stapler according to a second aspect of the present invention has a configuration in which a locking section, which is locked with the locking shaft when the cartridge is pulled out from the cartridge holding chamber of the stapler body, is formed in the cartridge.

In order to achieve the above-described second object, the stapler according to a third aspect of the present invention has a configuration in which the guide slots are formed at both sides of the cartridge holding chamber, the guide pawls guided in the guide slots are provided at both sides of the cartridge, and the cartridge can be detached from the stapler body by getting the guide pawls out of the guide slots.

In order to achieve the above-described third object, the stapler according to a fourth aspect of the present invention has a configuration in which the stapler comprises: a stapler body; and a cartridge which is mounted on a cartridge holding chamber of a stapler body in such a way that the cartridge can be pulled out from the cartridge holding chamber, wherein guide members, by which a refill for staples accommodated in the cartridge is guided in the direction in which the cartridge is mounted, are formed in the upper portion of the cartridge holding chamber.

BEST MODE OF CARRYING OUT THE INVENTION

A stapler according to the present invention is built into a copying machine and an electric stapler of a desk-top type, and is driven by a driving mechanism and a control mechanism (not shown) provided in the copying machine and the electric stapler of a desk-top type to perform stapling operation by which a plurality of sheets of paper are filed into one thing. Here, drawings and detailed explanation for the driving mechanism and the control mechanism, which perform filing operation, will be eliminated in the present embodiment.

Figure 1:
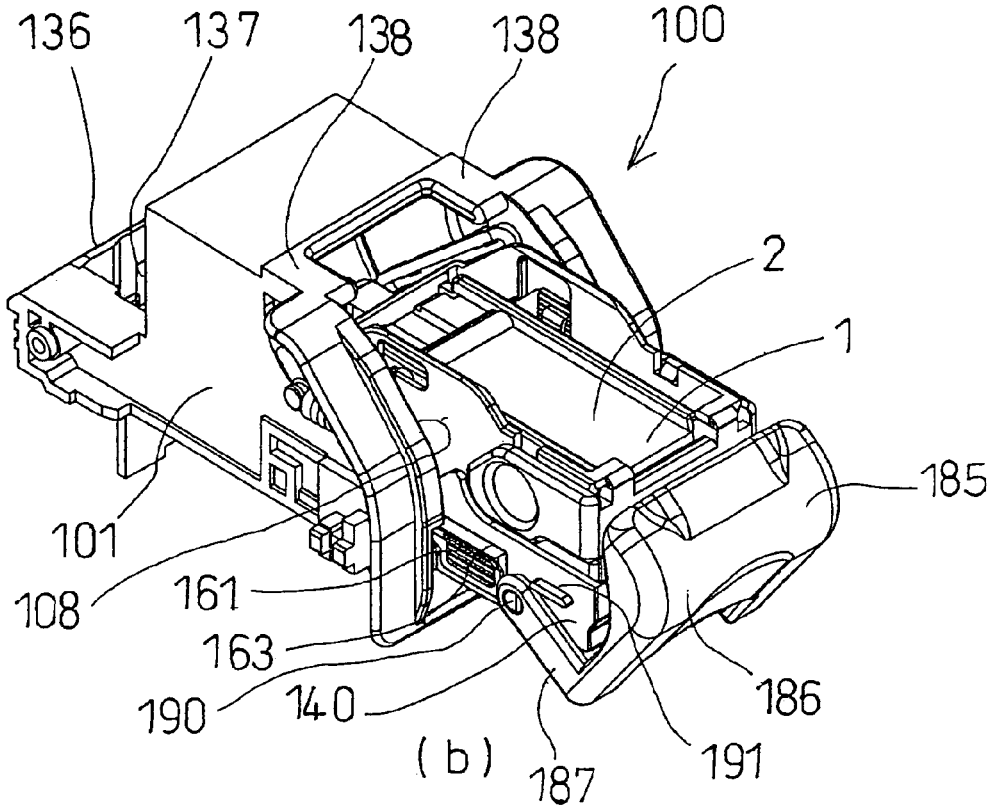
FIG. 1(A) is a general perspective view showing a stapler according to one embodiment of the present invention.
FIG. 1(B) is a general perspective view showing a stapler according to one embodiment of the present invention.
Figure 1:
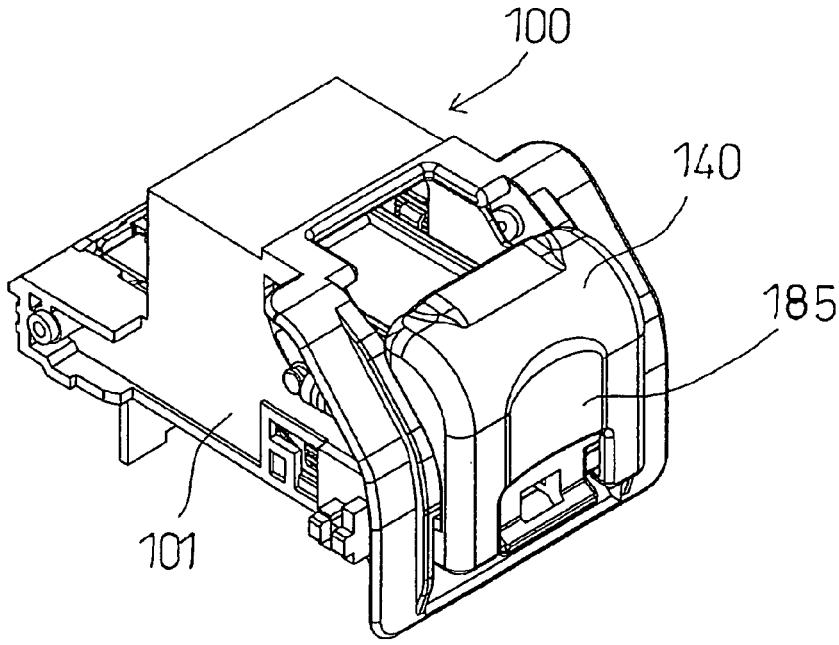
Figure 2:
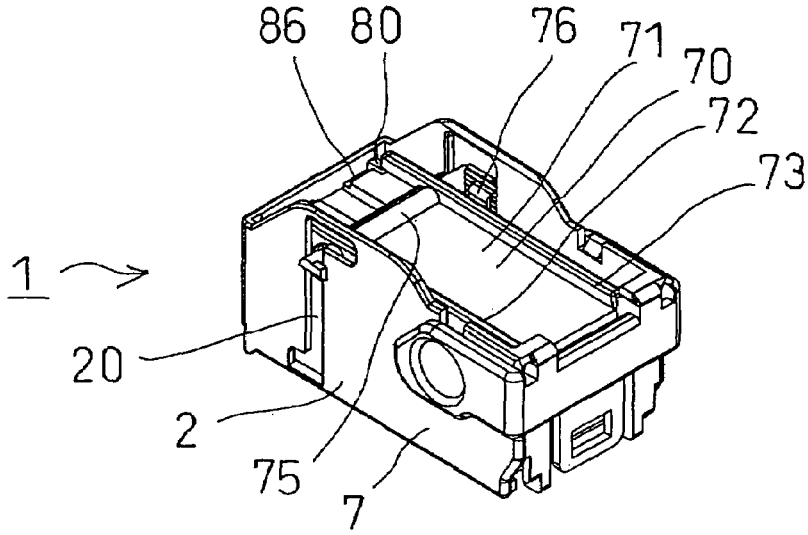
FIG. 2 is a perspective view showing a state in which a refill for staples is removed from a cartridge mounted on a stapler body.
Figure 2:
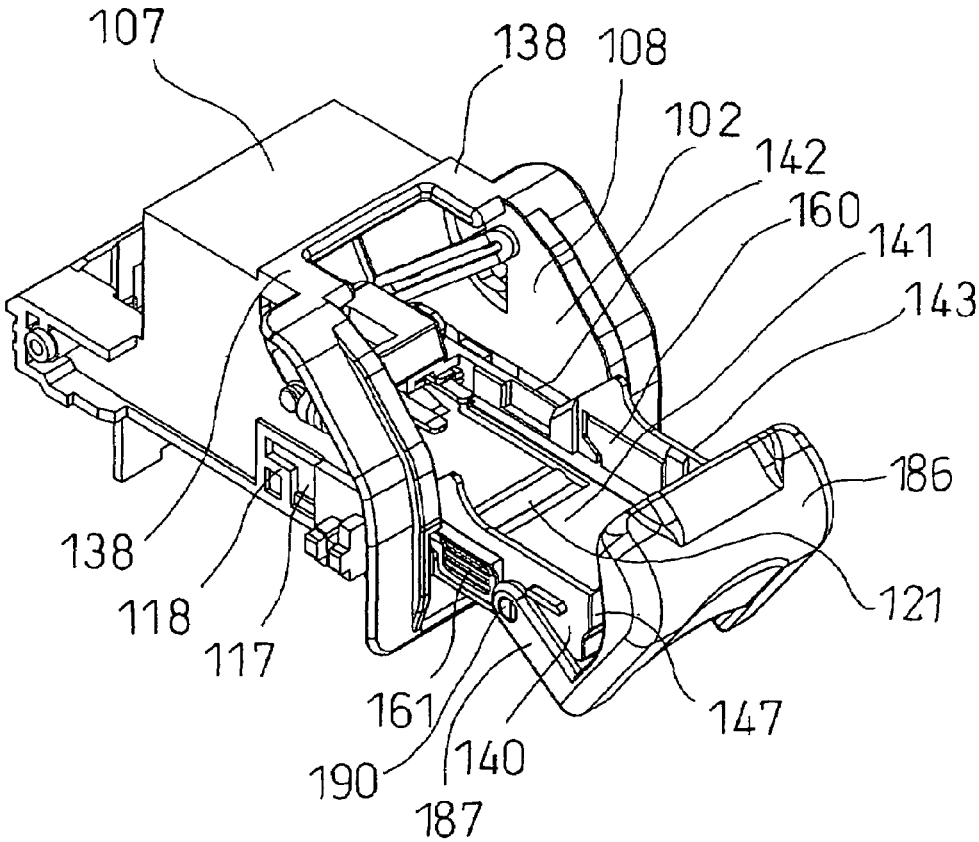
Figure 3:
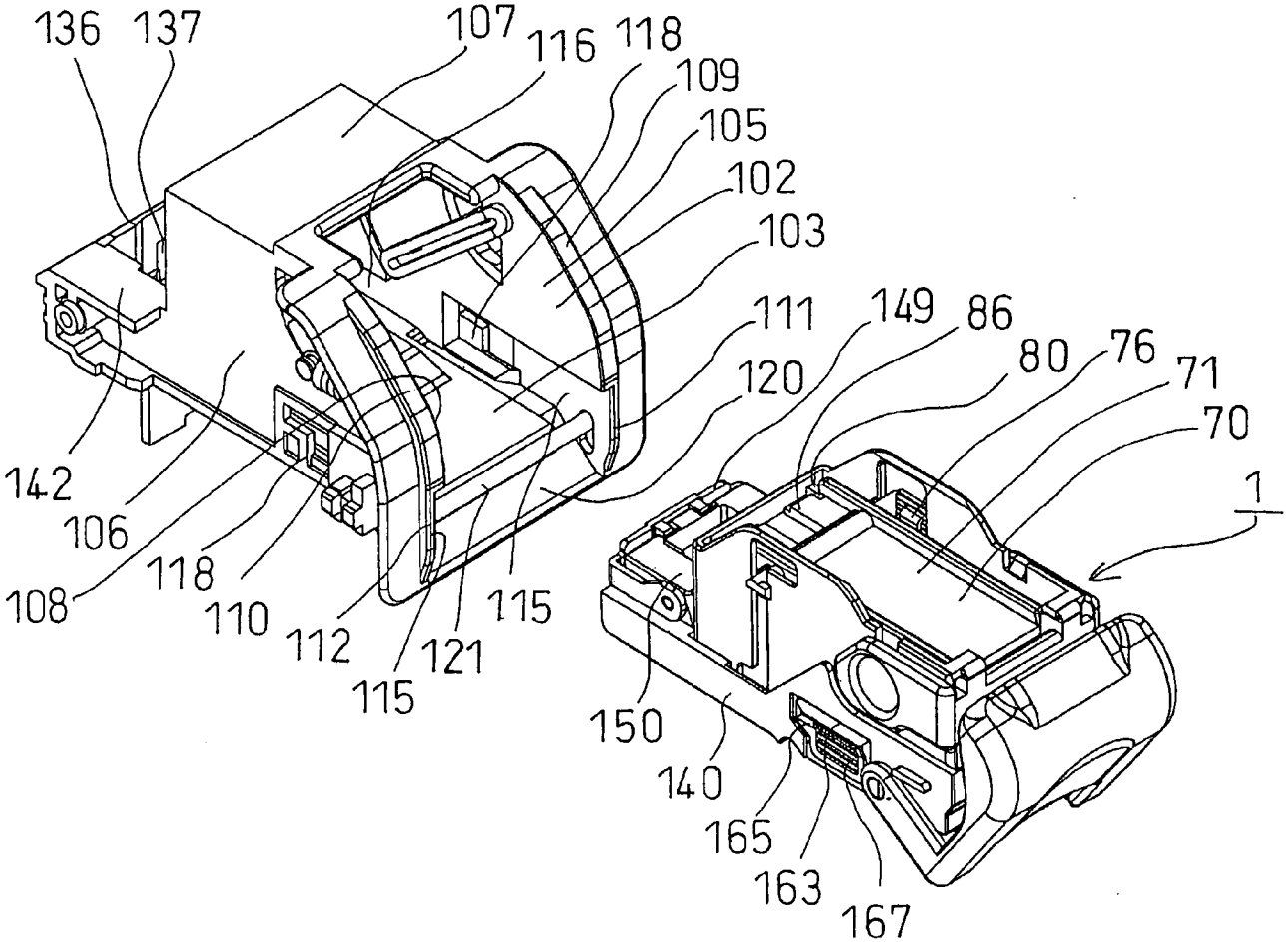
FIG. 3 is a perspective view showing a state in which the cartridge is removed from the stapler body.
Figure 4:
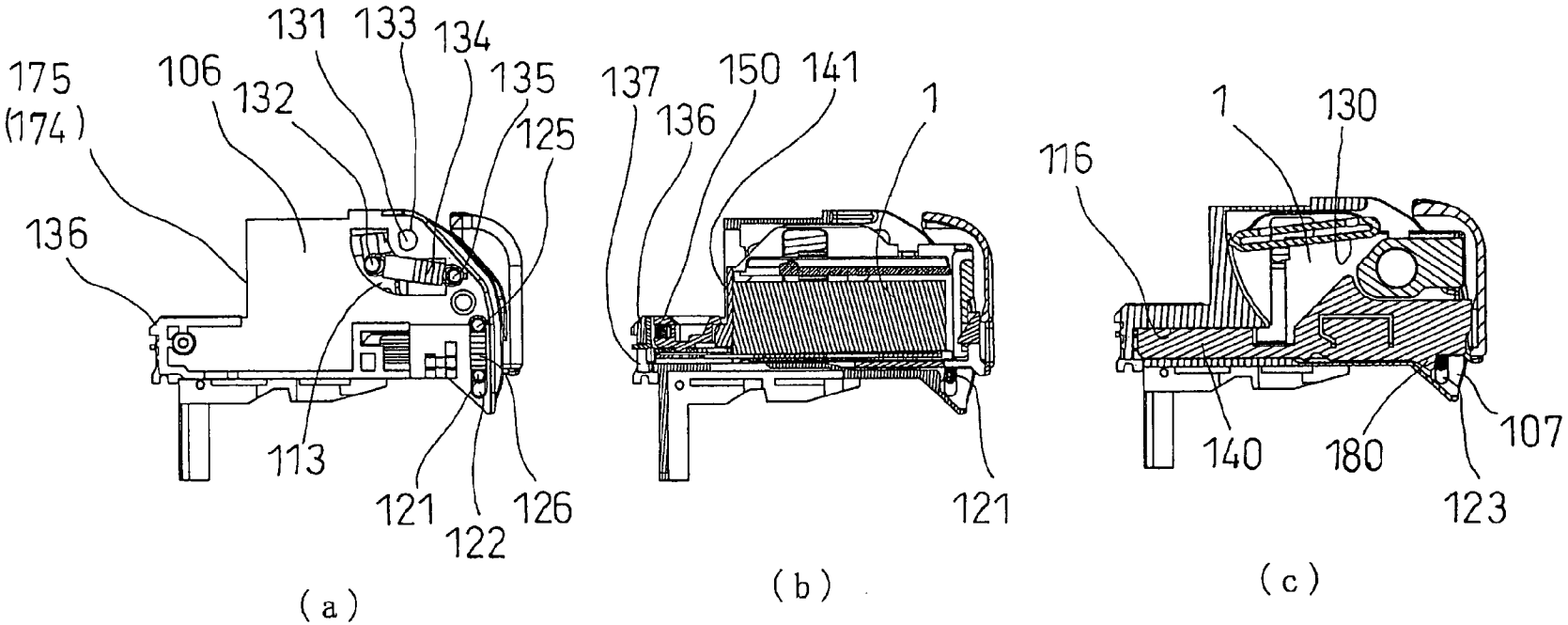
FIG. 4(A) is an explanatory view of a state in which the cartridge is mounted on the stapler body.
FIG. 4(B) is an explanatory view of a state in which the cartridge is mounted on the stapler body.
FIG. 4(C) is an explanatory view of a state in which the cartridge is mounted on the stapler body.
Figure 5:
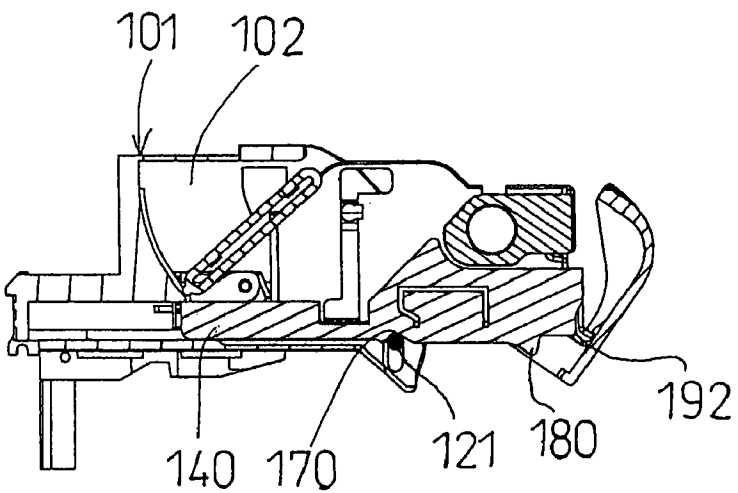
FIG. 5(A) is an explanatory view of a state in which the cartridge is pulled out from the stapler body.
FIG. 5(B) is an explanatory view of a state in which the cartridge is pulled out from the stapler body.
Figure 5:
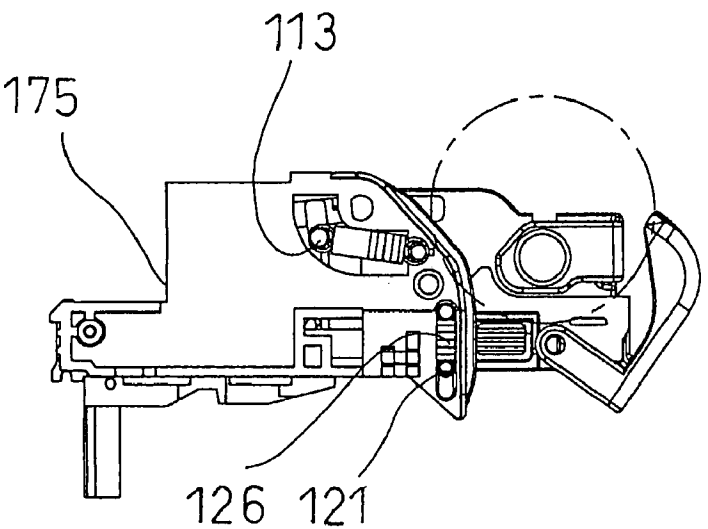

One embodiment of the stapler according to the present invention will be explained, referring to FIG. 1(A) through FIG. 18(F). FIG. 1(A) and FIG. 1(B) are a general perspective view showing the embodiment of the stapler according to the invention: FIG. 1(A) is a perspective view of a state in which a cartridge is pushed into and mounted on a stapler body; and FIG. 1(B) is a perspective view of a state in which the cartridge is pulled out from the stapler body. FIG. 2 is a perspective view of a state in which a refill for staples is detached from the cartridge mounted on the stapler body. FIG. 3 is a perspective view in which the cartridge is removed from the stapler body. FIG. 4(A) through FIG. 4(C) are an explanatory view of a state in which the cartridge is mounted on the stapler body: FIG. 4(A) is a side view; and FIG. 4(B) and FIG. 4(C) are side sectional views.

Figure 6:
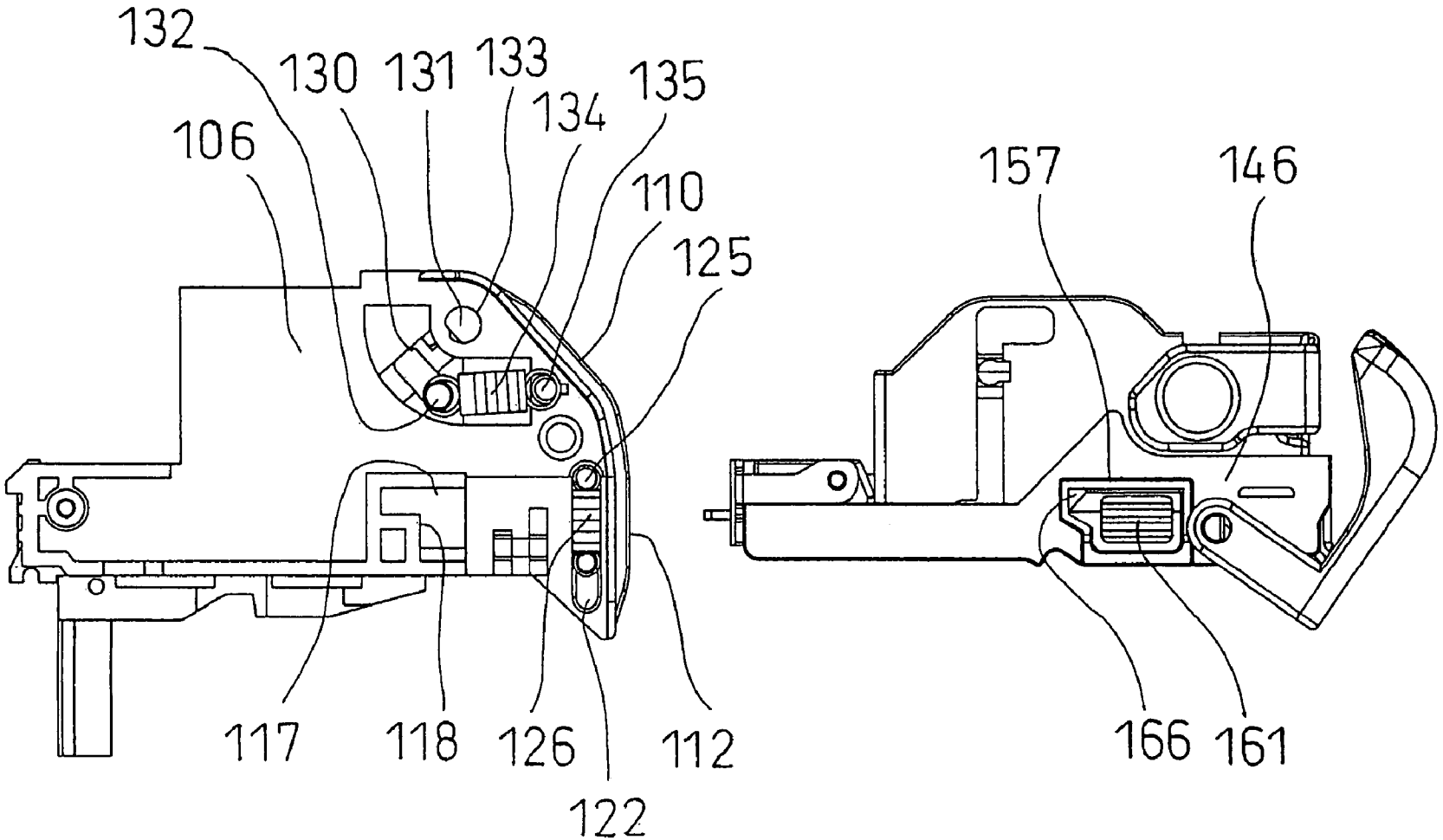
FIG. 6 is a side view of a state in which the cartridge is detached from the stapler body.
Figure 7:
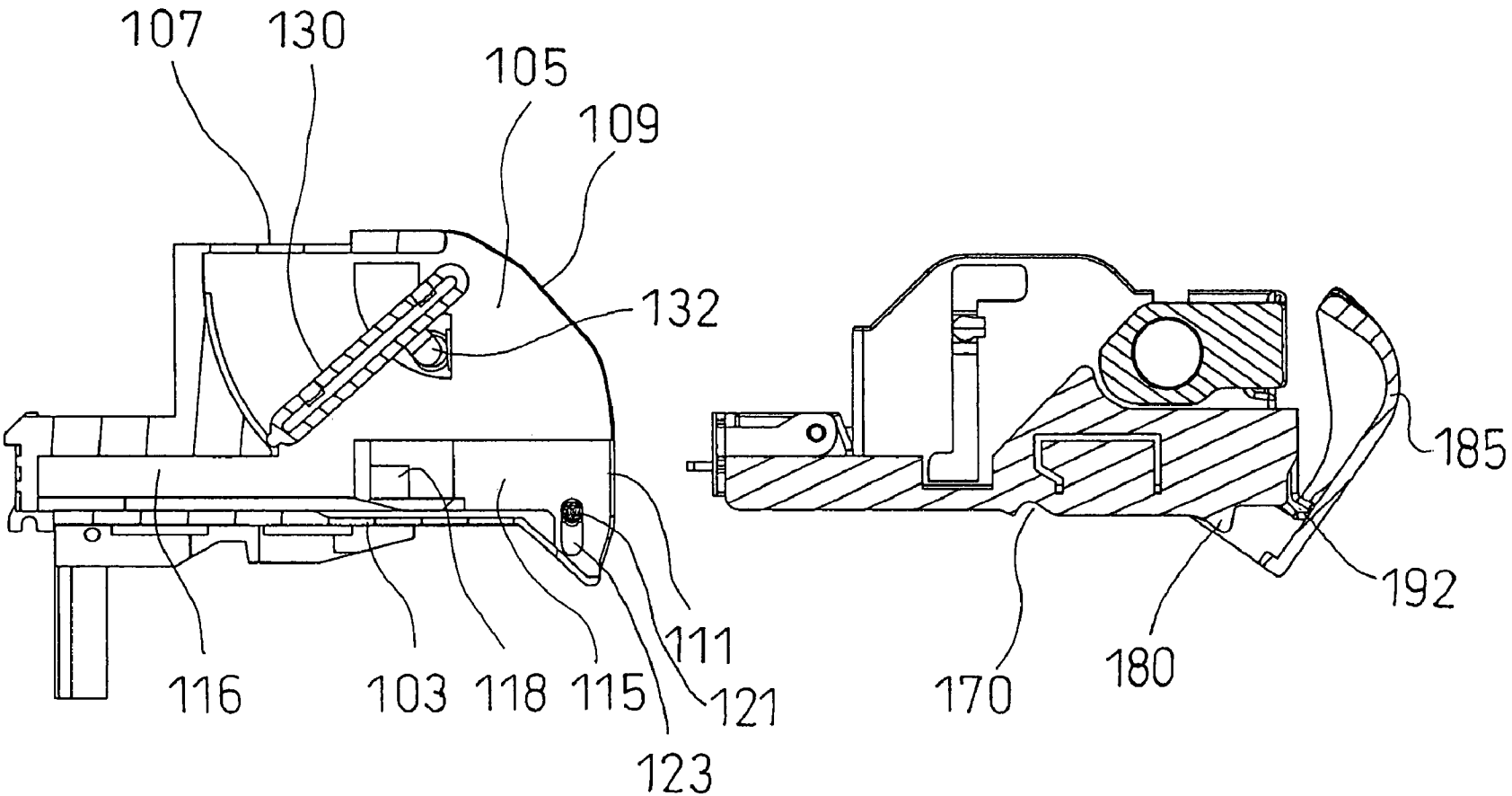
FIG. 7 is a sectional view for the state shown in FIG. 6.
Figure 8:
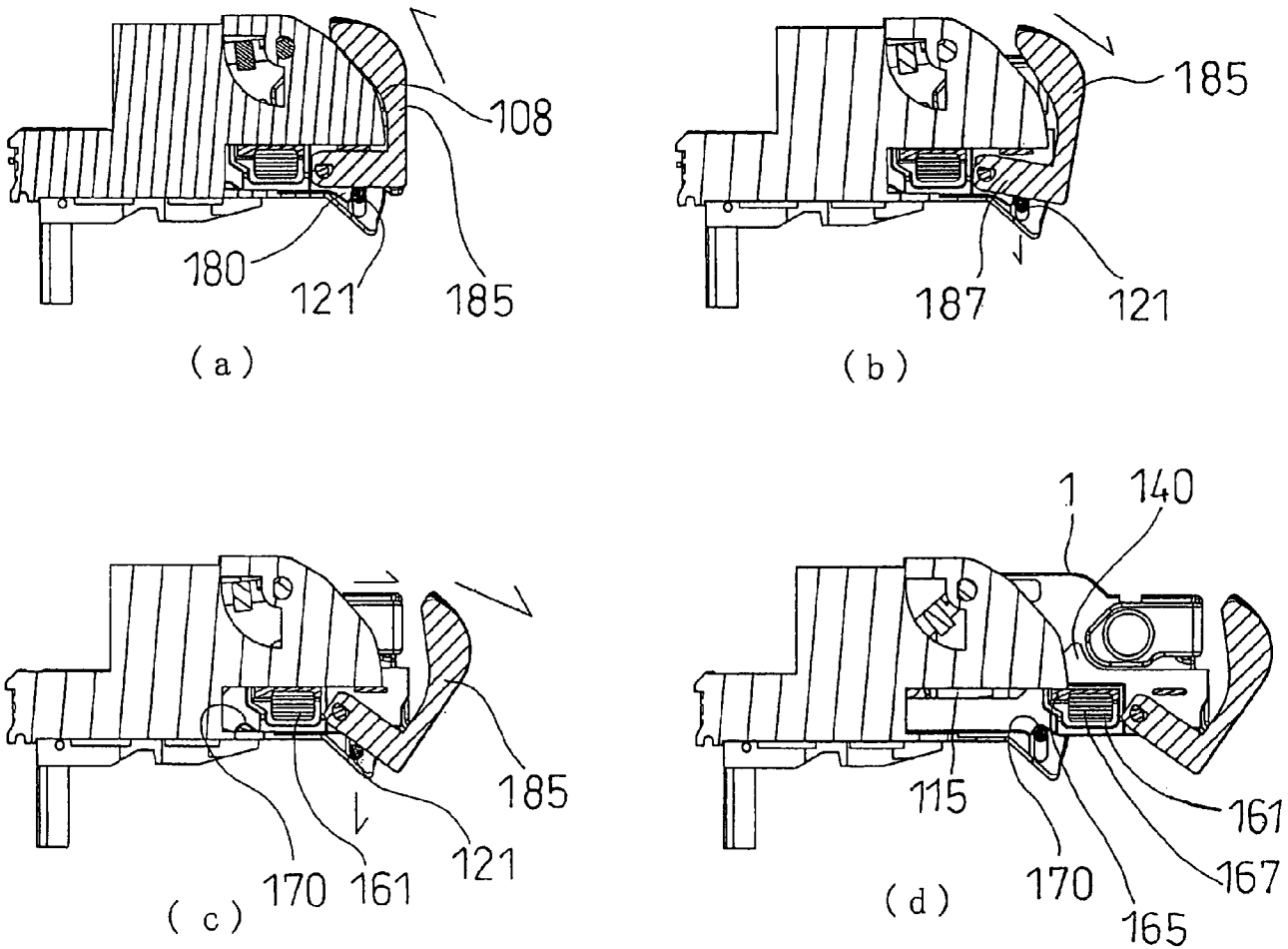
FIG. 8(A) is an explanatory view explaining an operation for pulling out the cartridge from the stapler body.
FIG. 8(B) is an explanatory view explaining an operation for pulling out the cartridge from the stapler body.
FIG. 8(C) is an explanatory view explaining an operation for pulling out the cartridge from the stapler body.
FIG. 8(D) is an explanatory view explaining an operation for pulling out the cartridge from the stapler body.
Figure 9:
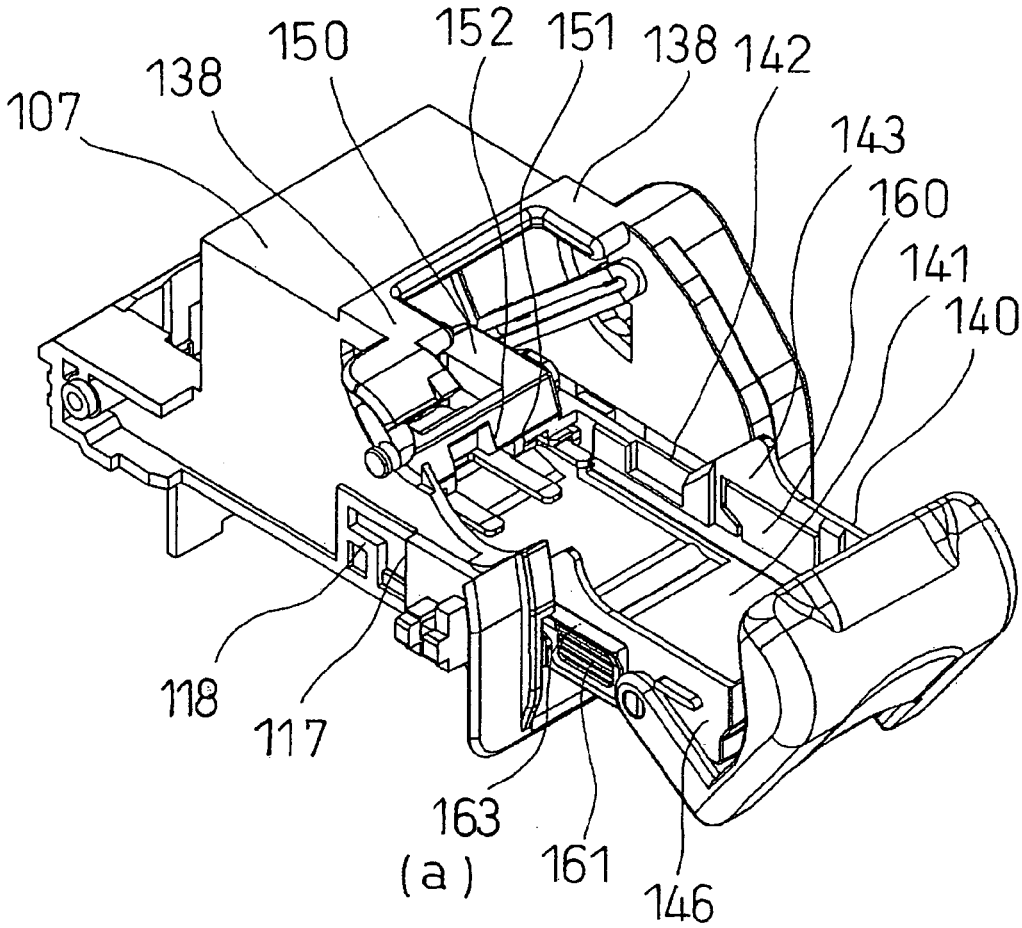
FIG. 9(A) is a perspective view showing a state before the refill for staples is accommodated in the cartridge of the stapler body.
FIG. 9(B) is a perspective view showing a state before the refill for staples is accommodated in the cartridge of the stapler body.
Figure 9:
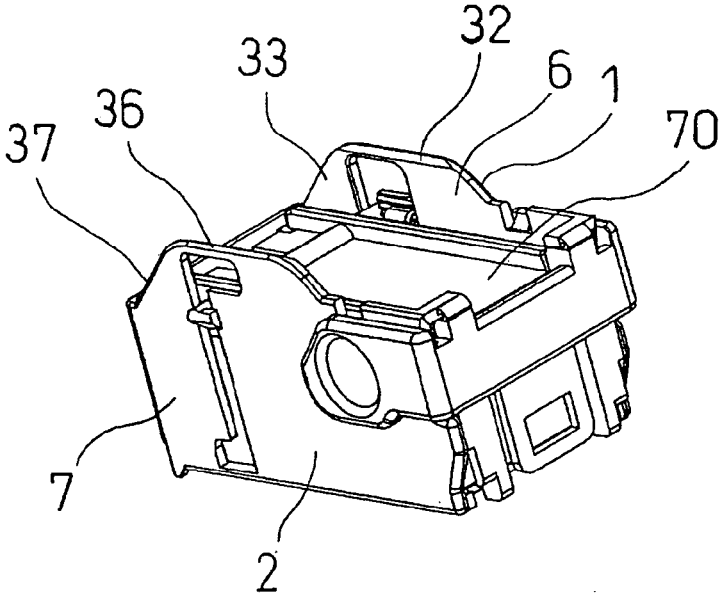
Figure 10:
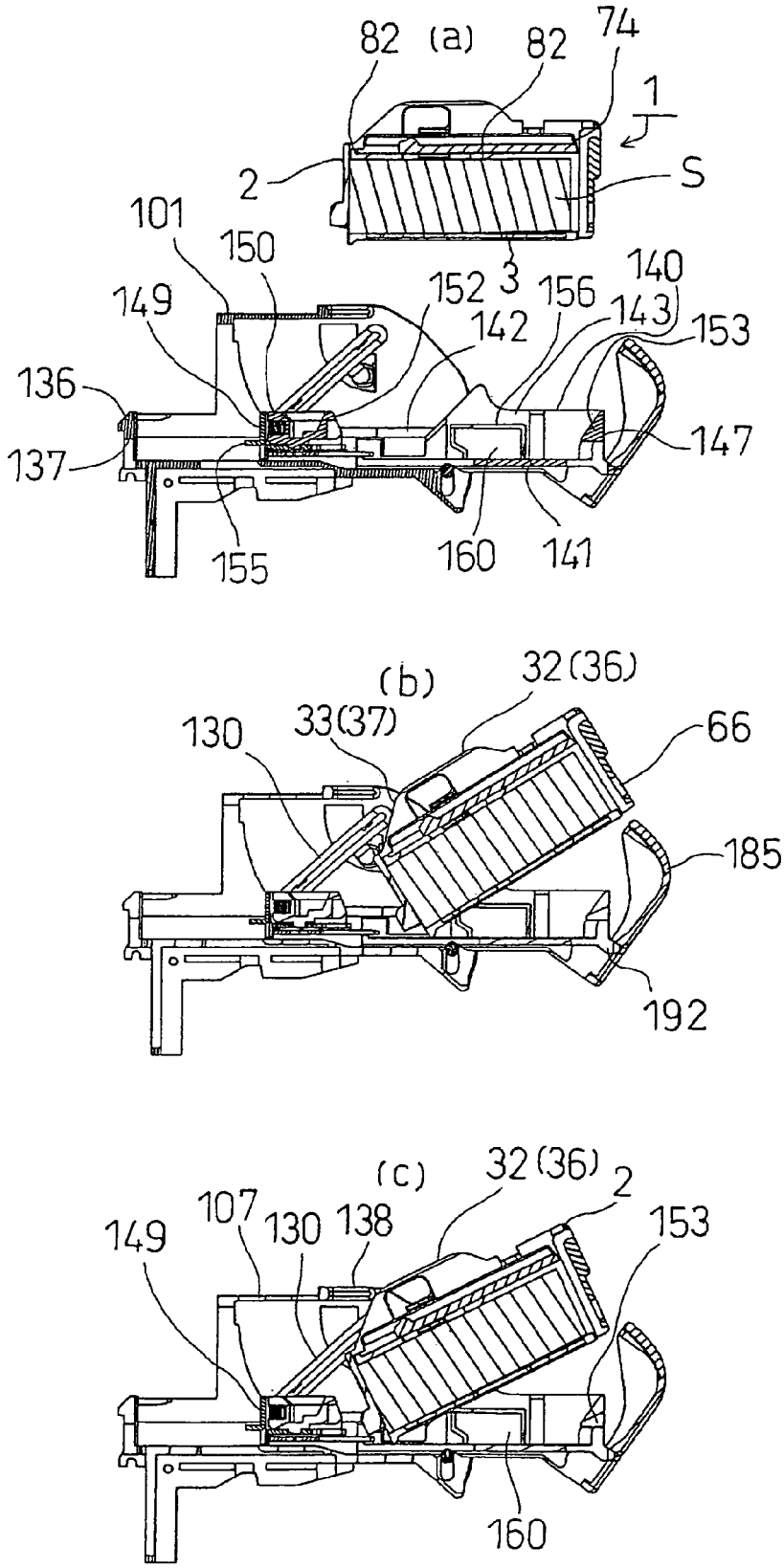
FIG. 10(A) is an explanatory view explaining an operation for accommodating the refill for staples in the cartridge of the stapler body.
FIG. 10(B) is an explanatory view explaining an operation for accommodating the refill for staples in the cartridge of the stapler body.
FIG. 10(C) is an explanatory view explaining an operation for accommodating the refill for staples in the cartridge of the stapler body.
Figure 11:
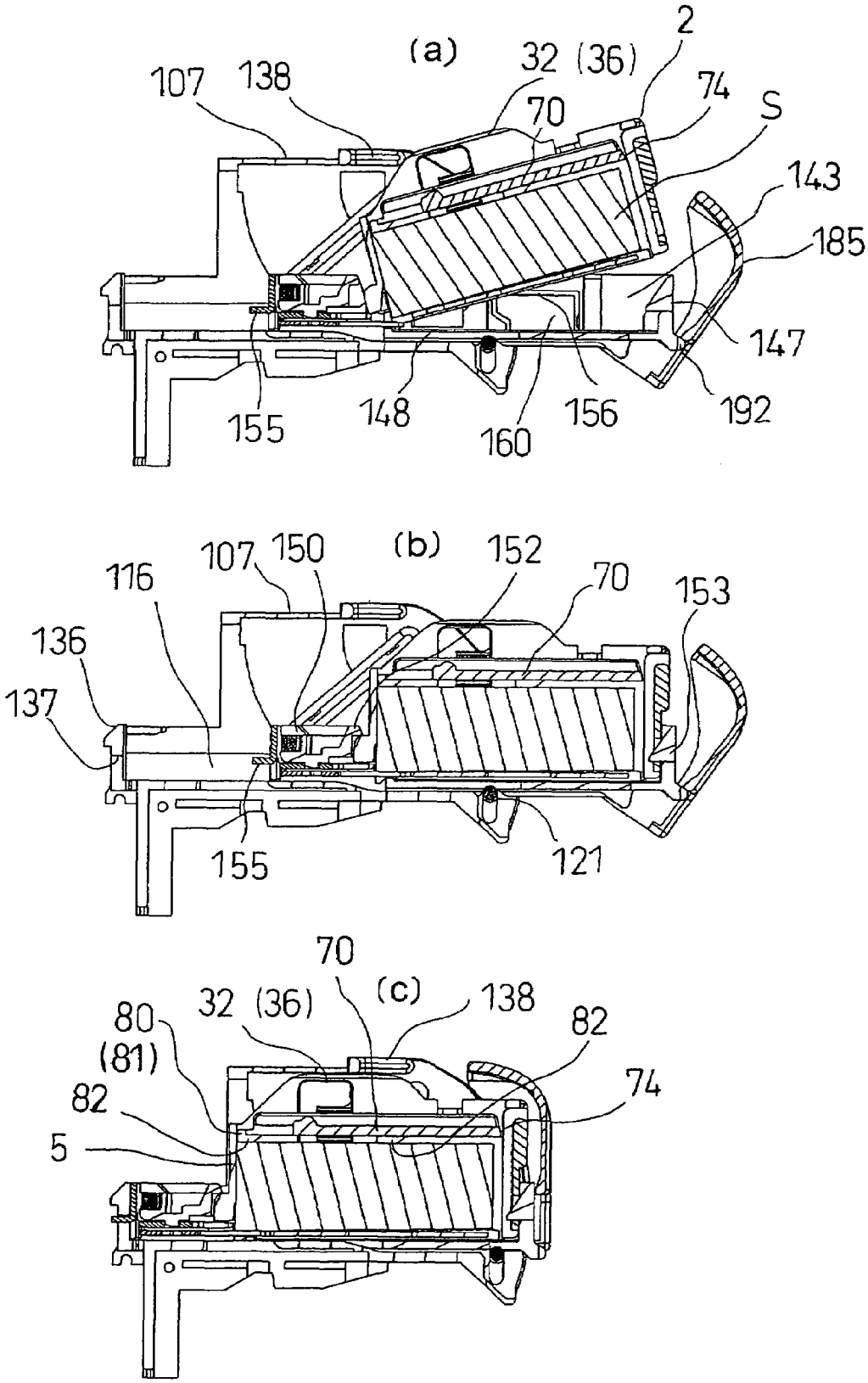
FIG. 11(A) is an explanatory view explaining an operation for accommodating the refill for staples in the cartridge of the stapler body.
FIG. 11(B) is an explanatory view explaining an operation for accommodating the refill for staples in the cartridge of the stapler body.
FIG. 11(C) is an explanatory view explaining an operation for accommodating the refill for staples in the cartridge of the stapler body.
Figure 12:
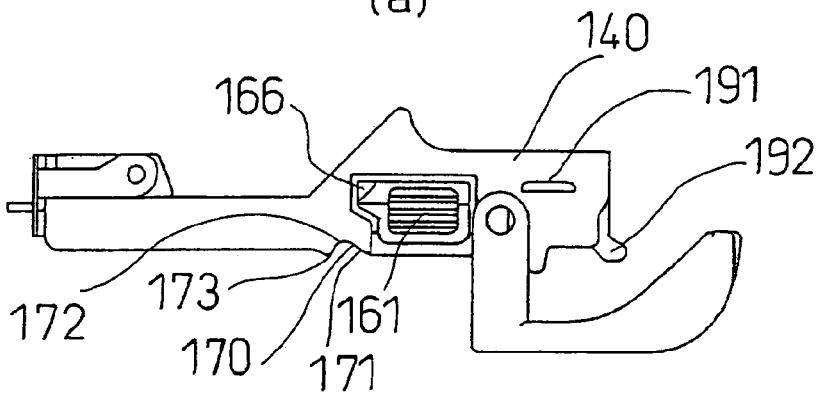
FIG. 12(A) is a side view explaining an operation for the cartridge.
FIG. 12(B) is a side view explaining an operation for the cartridge.
FIG. 12(C) is a side view explaining an operation for the cartridge.
Figure 12:
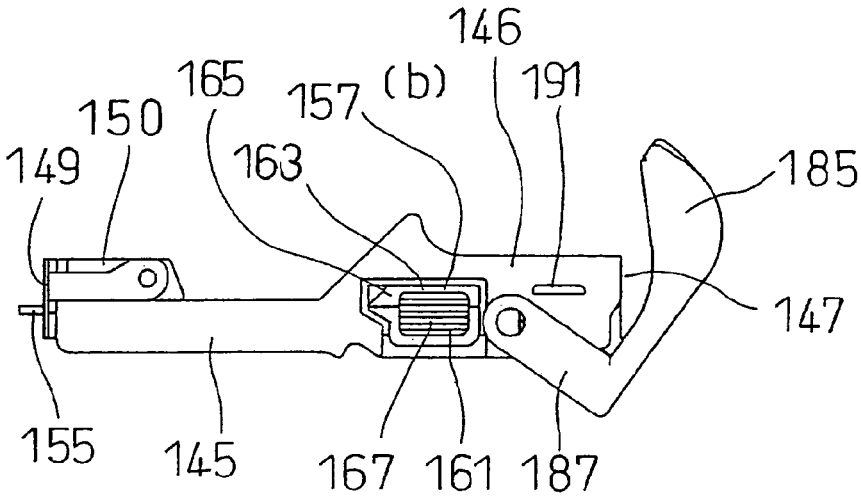
Figure 12:
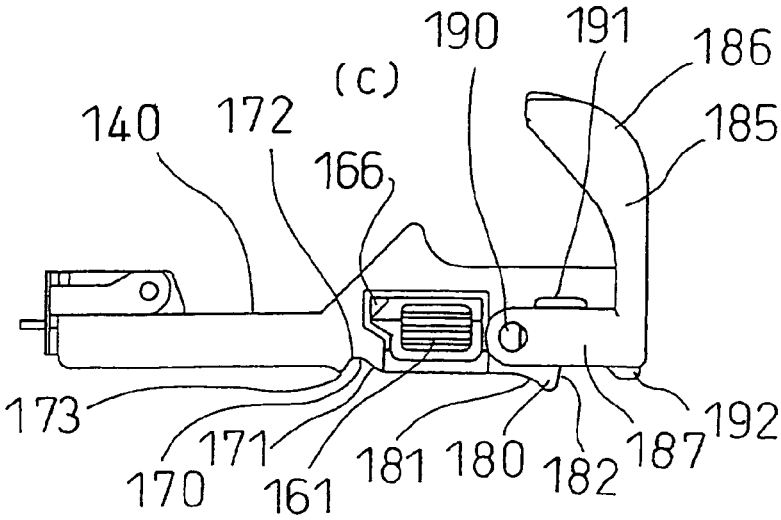
Figure 13:
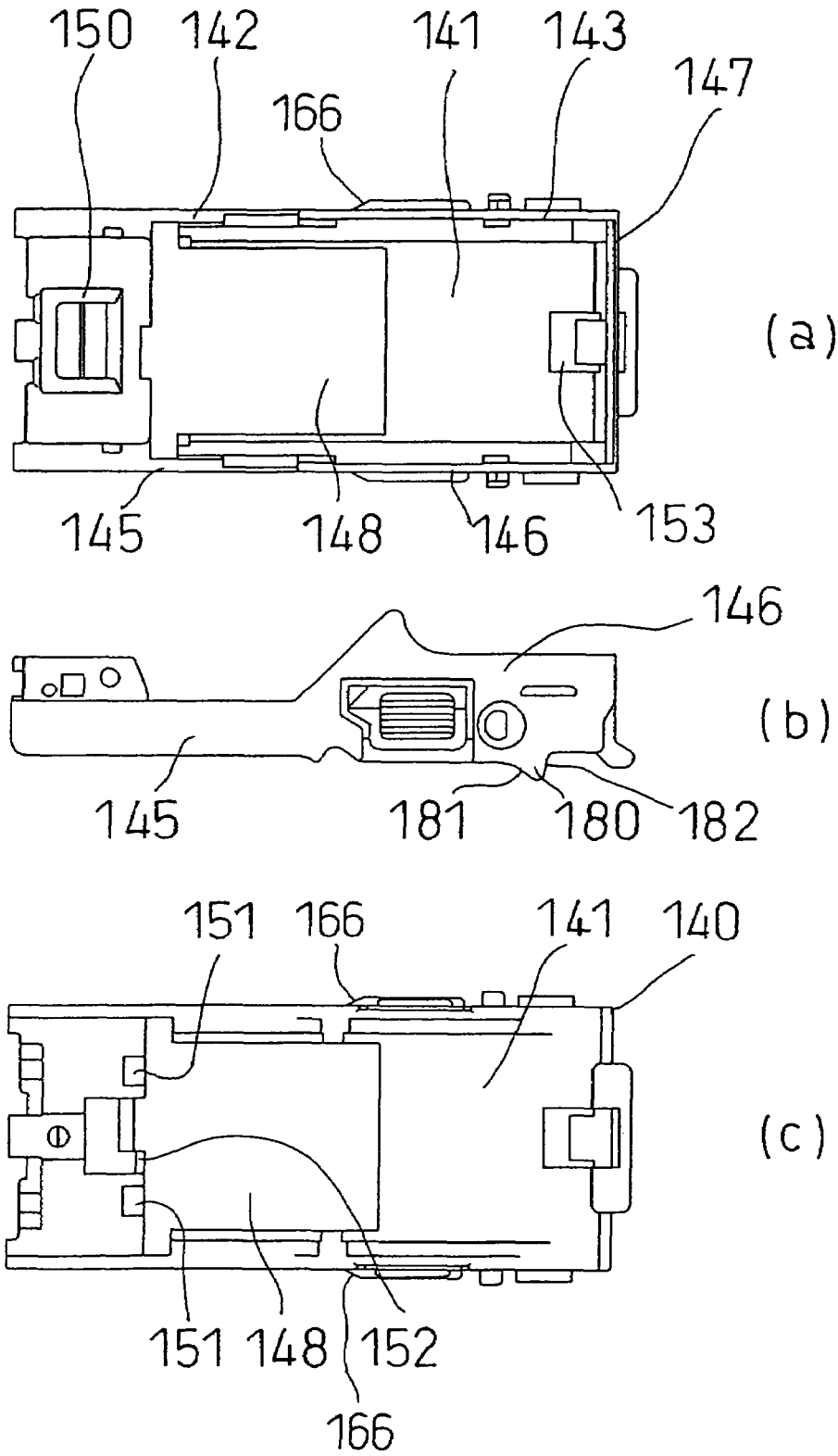
FIG. 13(A) is an explanatory view of the cartridge.
FIG. 13(B) is an explanatory view of the cartridge.
FIG. 13(C) is an explanatory view of the cartridge.
Figure 14:
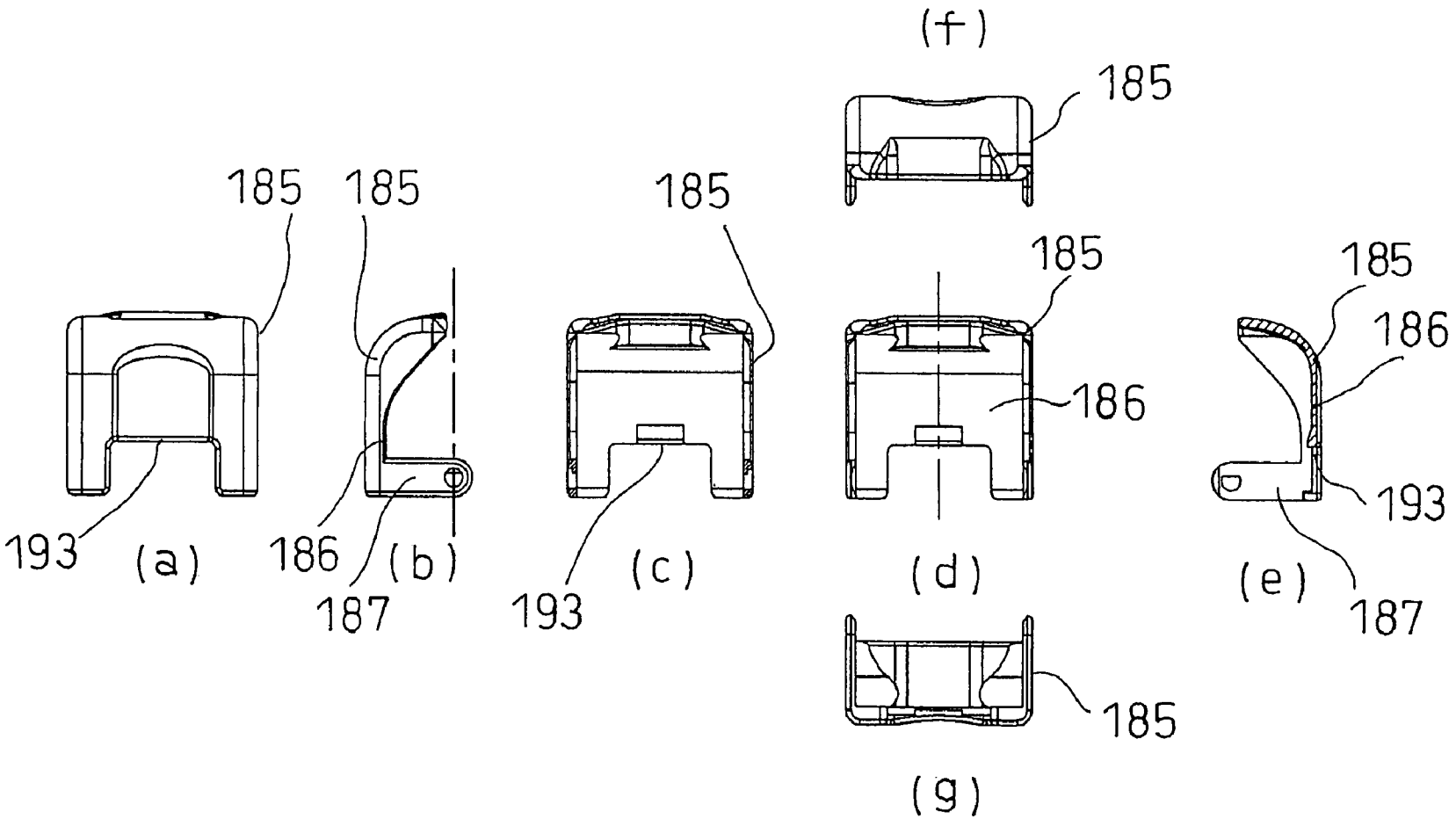
FIG. 14(A) is an explanatory view of a door member installed in the cartridge.
FIG. 14(B) is an explanatory view of a door member installed in the cartridge.
FIG. 14(C) is an explanatory view of a door member installed in the cartridge.
FIG. 14(D) is an explanatory view of a door member installed in the cartridge.
FIG. 14(E) is an explanatory view of a door member installed in the cartridge.
FIG. 14(F) is an explanatory view of a door member installed in the cartridge.
FIG. 14(G) is an explanatory view of a door member installed in the cartridge.
Figure 15:
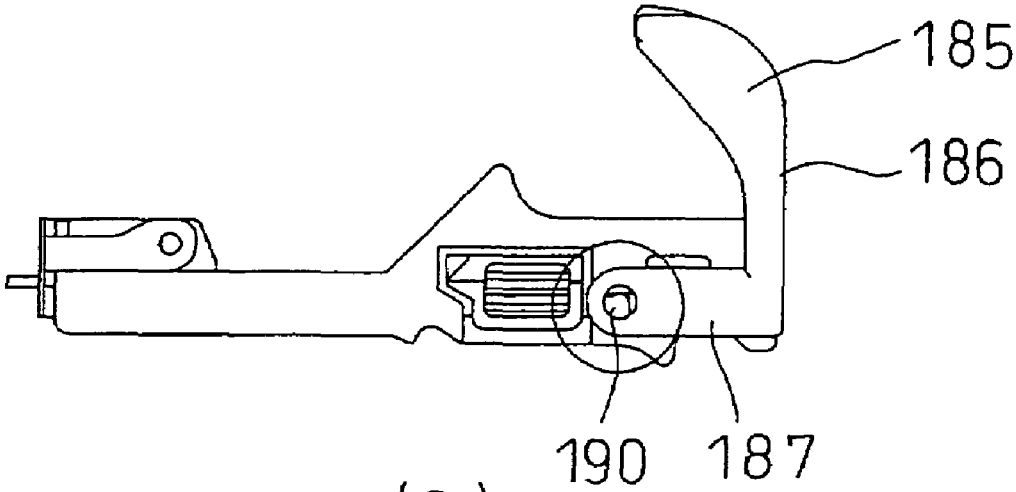
FIG. 15(A) is a principal explanatory view of the cartridge.
FIG. 15(B) is a principal explanatory view of the cartridge.
Figure 15:
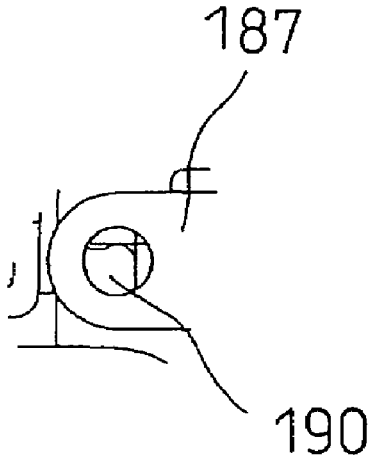
Figure 16:
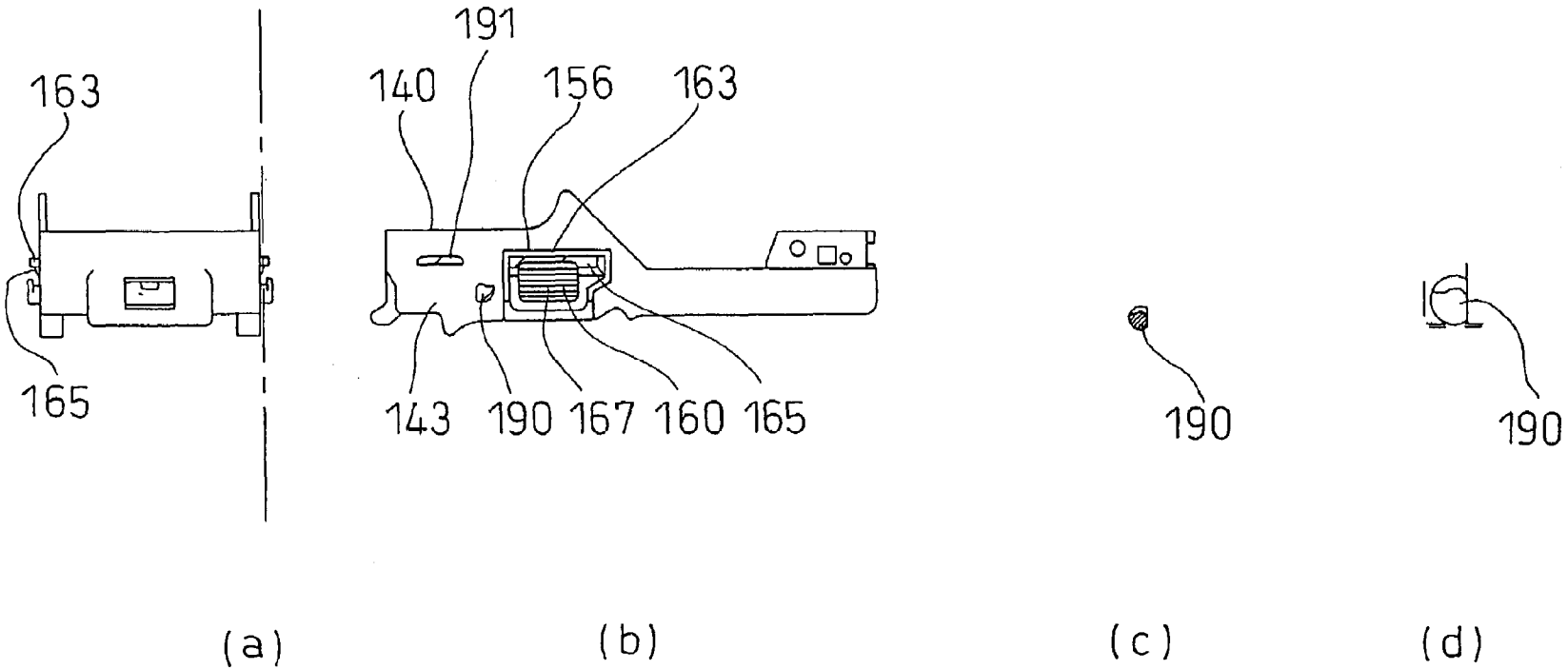
FIG. 16(A) is a principal explanatory view of the cartridge.
FIG. 16(B) is a principal explanatory view of the cartridge.
FIG. 16(C) is a principal explanatory view of the cartridge.
FIG. 16(D) is a principal explanatory view of the cartridge.
Figure 17:
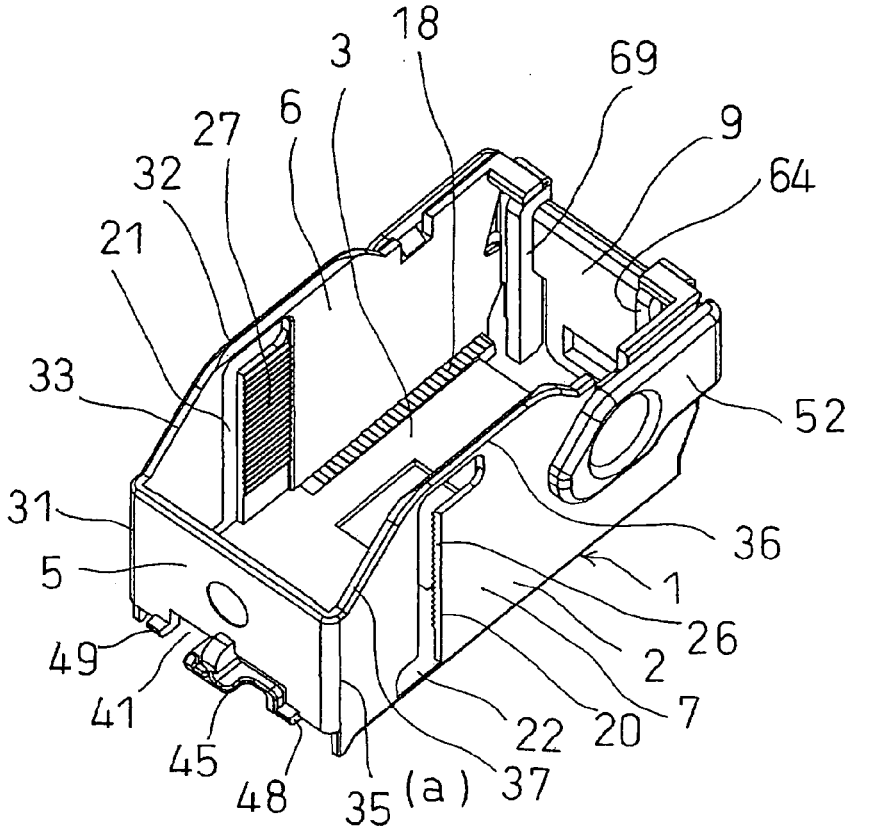
FIG. 17(A) is an explanatory view of the refill for staples.
FIG. 17(B) is an explanatory view of the refill for staples.
Figure 17:
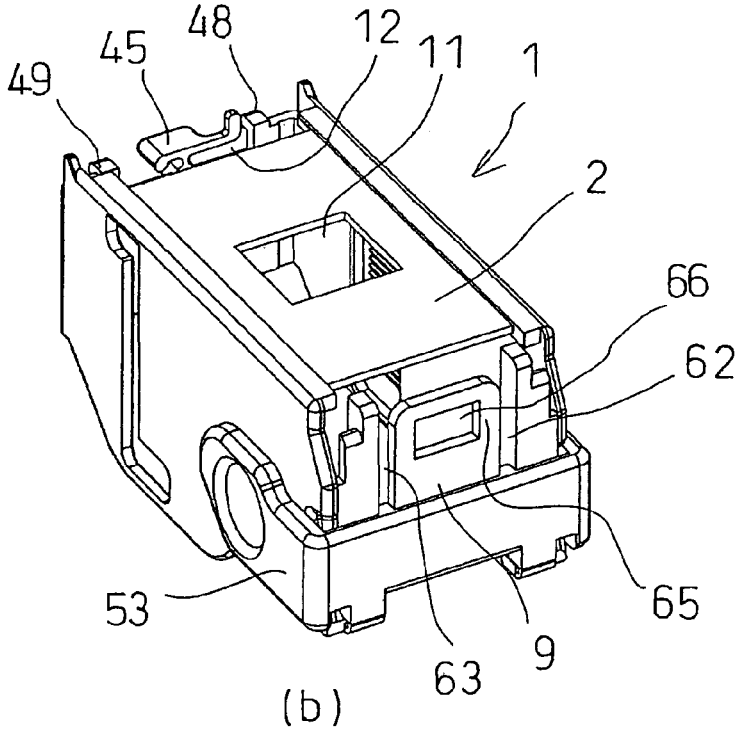
Figure 18:
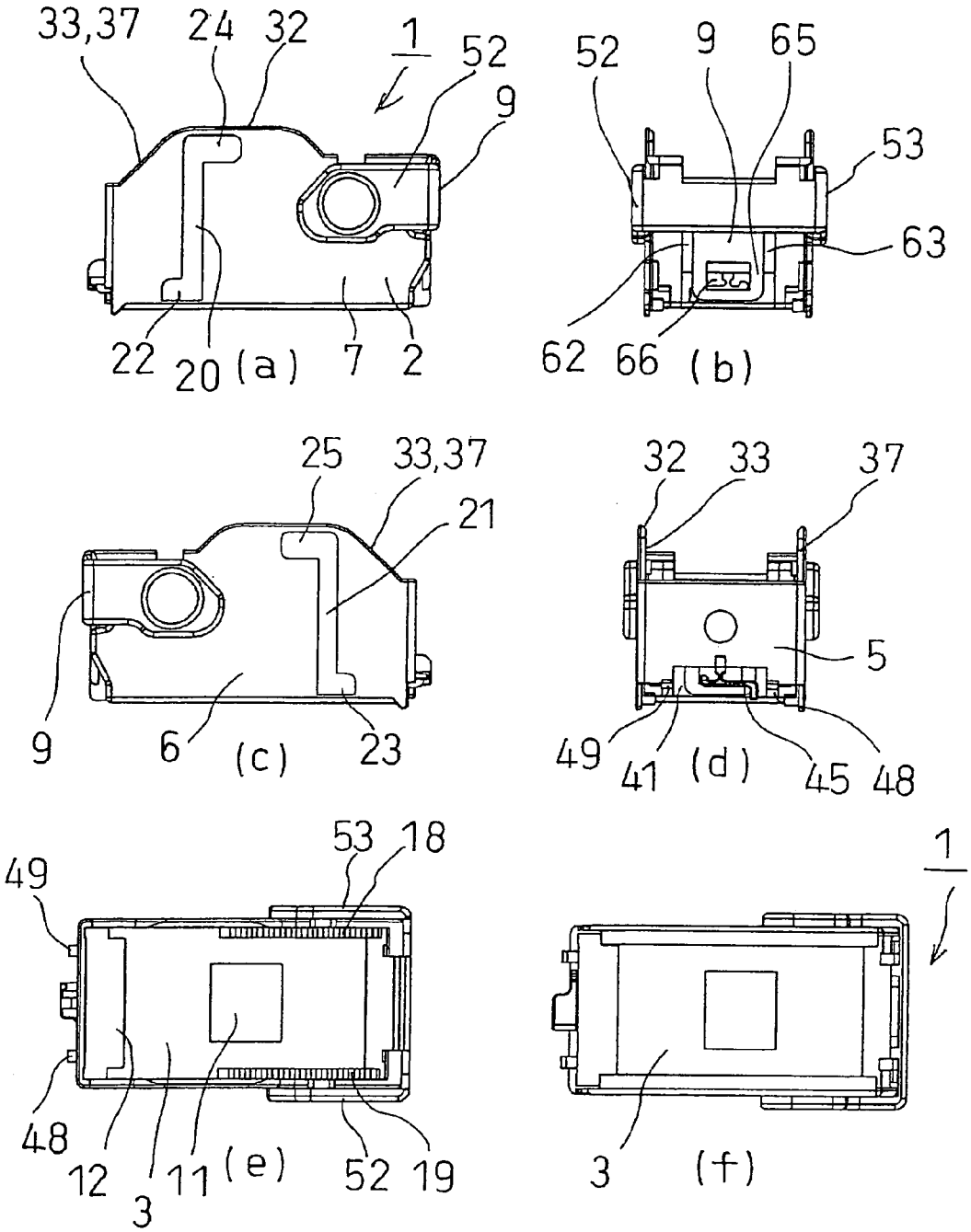
FIG. 18(A) is a view of the refill for staples.
FIG. 18(B) is a view of the refill for staples.
FIG. 18(C) is a view of the refill for staples.
FIG. 18(D) is a view of the refill for staples.
FIG. 18(E) is a view of the refill for staples.
FIG. 18(F) is a view of the refill for staples.

FIG. 5(A) and FIG. 5(B) are an explanatory view of a state in which the cartridge is pulled out form the stapler body: FIG. 5(A) is a side view; and FIG. 5(B) is a side sectional view. FIG. 6 is a side view of a state in which the cartridge is removed from the stapler body. FIG. 7 is a sectional view of a state corresponding to the state shown in FIG. 6. FIG. 8(A) through FIG. 8(D) are an explanatory view explaining operations for pulling out the cartridge from the stapler body. FIG. 9(A) through FIG. 9(B) are a perspective view showing a state before the refill for staples is accommodated in the cartridge of the stapler body.

FIG. 10(A) through FIG. 10(C), and FIG. 11(A) through FIG. 11(C) are an explanatory view explaining operations for accommodating the refill for staples in the cartridge of the stapler body. FIG. 12(A) through FIG. 12(C) are a side view explaining operations of the cartridge. FIG. 13(A) through FIG. 13(C) are an explanatory view of the cartridge: FIG. 13(A) is a top view; FIG. 13(B) is a side view; and FIG.

13(C) is a bottom view. FIG. 14(A) through FIG. 14(G) are an explanatory view of a door member installed in the cartridge. FIG. 15(A) and FIG. 15(B), and FIG. 16(A) through FIG. 16(D) is a principal explanatory view of the cartridge. FIG. 17(A) and FIG. 17(B) are an explanatory view of the refill for staples: FIG. 17(A) is a perspective view from above; and FIG. 17(B) is a perspective view from below. FIG. 18(A) through FIG. 18(F) are six views of the refill for staples.

A stapler 100 comprises: a stapler body 101; and a cartridge 140 which is mounted on a cartridge holding chamber 102 of the stapler body 101 in such a way that the cartridge 140 can be pulled out from the cartridge holding chamber 102. A refill 1 for staples, by which a needle(staple) is supplied to a staple mechanism (not shown) for filing sheets of paper, can be mounted on the above stapler body 101. The refill for staples accommodates a plurality of sheet-type connected stables S.

The stapler body 101 includes the cartridge holding chamber 102 which holds the cartridge 140 installing the above-described refill 1 for staples. Moreover, an opening 108 of the cartridge holding chamber 102 is provided behind the stapler body 101.

A locking shaft 121 which is biased upward by an elastic member 126 is provided under the opening 108 in the cartridge holding chamber 102. The cartridge 140 has a locking projection 180 and a door member 185. When the cartridge 140 is mounted on the cartridge holding chamber 102, the above-described locking projection 180 is locked with the above-described locking shaft 121, and the above-described door member 185 is biased so that the opening 108 in the cartridge holding chamber 102 is closed by the above-described locking shaft 121. When the door member 185 closing the opening 108 of the cartridge holding chamber 102 is opened, the door member 185 is configured to disengage the above-described locking shaft 121 from the locking projection 180.

According to the above-described configuration, when the cartridge 140 accommodating the refill 1 for staples is pushed into and mounted on the cartridge holding chamber 102, the locking projection 180 is engaged with the above-described locking shaft 121 to fix the cartridge 140 in the stapler body 101. Moreover, the door member 185 is pushed up with the locking shaft 121 at the same time the above cartridge 140 is fixed, and a part of the opening 108 is covered. As the door member 185 pushes the above-described locking shaft 121 down when the door member 185 is pulled in the above state so as to be opened, the locking projection 180 is disengaged from the locking shaft 121 of the cartridge 140. When the above door member 185 is operated, the mounted cartridge 140 can be pulled out from the stapler body 101.

A locking section 170, which is locked with the above-described locking shaft 121 when the cartridge 140 is pulled out from the cartridge holding chamber 102 of the stapler body 101, is formed in the cartridge 140. The locking section 170 is formed as a concave portion at bottom of the cartridge 140 to fix the cartridge 140 by engaging the locking shaft 121 with the above locking section (locking concave section) 170.

Guide slots 115 are formed at each side of the cartridge holding chamber 102. Guide pawls 160 and 161 guided by the above-described guide slots 115 are formed at both sides of the cartridge 140, respectively, and the cartridge 140 can be removed from the stapler body 101 by detaching the above guide pawls 160 and 161 from the corresponding guide slots 115, respectively. The guide pawls 160 and 161 are of a flexible member, and have portions protruding from both side surfaces of the cartridge 140 to the outside, respectively. The protruded portions are guided in the above-described guide slots 115. The guide pawls 160 and 161 are bent by pushing inward to disengage the above-described protruded portions from the guide slots 115.

The stapler 100 comprises: the stapler body 101; and the cartridge 140 which is mounted on the cartridge holding chamber 102 of the stapler body 101 in such a way that the cartridge 140 can be pulled out from the cartridge holding chamber 102. A guide member 138, by which the refill 1 for staples accommodated in the cartridge 140 is guided in the direction in which the cartridge 140 is mounted, is formed in the upper portion of the cartridge holding chamber 102.

Hereinafter, the stapler will be explained in more detail. As shown in FIG. 17(A) and FIG. 17(B), and FIG. 18(A) through FIG. 18(F), the refill 1 for staples comprises: a refill body 2; and a pressing member 70. The refill body 2 comprises: a bottom wall 3; a front wall 5 provided at about right angles to the front portion of the bottom wall 3, a right wall 6 provided at about right angles to the right portion of the bottom wall 3, a left wall 7 provided at about right angles to the left portion of the bottom wall 3, and a locking plate 9 rotatably provided at the rear portion of the bottom wall 3.

A look-through hole 11 with a rectangular shape is formed at about the center on the bottom wall 3, a notch 12 with a shape of substantially "U" is formed at the front end of the bottom wall 3, and projections for backward-motion prevention 18 and 19, which prevent the backward motion of the sheet-type connected staples S, are continuously formed on the left and right sides of the upper surface (the side of the inner surface of the body 2) of the bottom wall 3, respectively. A guide slot 20 extending in the vertical direction is formed in the front portion of the left wall 7, and a guide slot 21 extending in the vertical direction is formed in the front portion of the right wall 6. A concave portion 22 is formed to the front at the lower end of the guide slot 20, and a concave portion 23 is formed to the front at the lower end of the guide slot 21. A concave portion 24 is formed to the rear at the upper end of the guide slot 20, and a concave portion 25 is formed to the rear at the upper end of the guide slot 21. Small projection 26 with a substantially triangle shape is continuously formed in the vicinity of the guide slot 20, and small projection 27 with a substantially triangle shape is continuously formed in the vicinity of the guide slot 21.

A right inclined edge 33 extending from a front end edge 31, which is about vertical, to an upper end edge 32, which is about horizontal, is formed in the front portion of the right wall 6. Similarly, a left inclined edge 37 extending from a front end edge 35, which is about vertical, to an upper end edge 36, which is about horizontal, is formed in the front portion of the right wall 7.

A delivery port 41 delivering sheet-type connected staples S is formed in the lower portion of the front wall 5. This delivery port 41 is in communication with the notch 12 of the bottom wall 3. A covering member 45 closing the delivery port 41 is provided in the upper portion of the delivery port 41. Moreover, a pair of projection-like locking sections 48 and 49 are formed at both ends of the front wall 5 in the lower portion, respectively.

Bearing plates 52 and 53 are formed as one body: the bearing plate 52 is formed in the upper left end of the locking plate 9; and the bearing plate 53 is formed in the upper right end of the locking plate 9. The bearing plate 52 is rotatably pivoted in the upper portion of the left wall 7, and the bearing plate 53 is rotatably pivoted in the upper portion of the right wall 6. A flexible piece 65, both sides of which are inserted between slots 62 and 63, respectively, is provided on the locking plate 9. A locking hole 66 is formed on this flexible piece 65. Resting projections 64 and 69 extending from the upper end to the lower end of the locking plate 9 are provided on the inner side surface of the locking plate 9.

As shown in FIG. 2, the pressing member 70 comprises: a pressing plate 71; a reinforcing wall 72 provided on the left side of the pressing plate 71, a reinforcing wall 73 provided on the right side of the pressing plate 71; and a guide shaft 75 provided in such a way that one end of the shaft 75 is protruding from the left reinforcing wall 72, and the other end is protruding from the right reinforcing wall 73. Both sides of the guide shaft 75 are configured to be guided in the guide slot 20 of the left wall 7 and the guide slot 21 of the right wall 6. In the vicinity of the guide shaft 75, there is provided a locking piece 76 which prevents the pressing member 70 from moving upward and allows the member 70 to move downward as the pieces 76 are locked with the small projections 26 and 27.

Guide projections 80 and 80 are formed at both sides of locking shoulder sections 86 and 86 on the pressing plate 71, respectively. Moreover, a pair of pressing projections 82 pressing the sheet-type connected staple S is provided at about the center of the lower surface of the pressing plate 71, and on the lower surface of the guide projections 80 and 81.

The sheet-type connected staples S are formed by bonding a plurality of staples with a thin rod-like shape to form sheet-type staples. When staples are driven into a predetermined sheets of paper, only a staple at the tip is driven.

The stapler body 101 of the stapler 100 is mounted on a copying machine or a printing machine, and the cartridge holding chamber 102 is formed as shown in FIG. 3. The cartridge 140 is mounted on this cartridge holding chamber 102 in such a way that the cartridge 140 can be pulled out from the cartridge holding chamber 102. The cartridge holding chamber 102 includes: a bottom wall 103; a right wall 105 formed at the right side of the bottom wall 103; a left wall 106 formed at the left side of the bottom wall 103: and a top wall 107. And, the front portion and the back portion of the cartridge holding chamber 102 are open.

The rear edge of the right wall 105 has a shape provided with: an inclined edge 109 which is inclined downward and rearward (in the direction in which the cartridge 140 is pulled out); and a vertical edge 111 which is extending downward, and the rear edge of the left wall 106 has a shape provided with: an inclined edge 110 which is inclined downward and rearward (in the direction in which the cartridge 140 is pulled out); and a vertical edge 112 which is extending downward. The front portion of the right wall 105 is notched, and a driver of the stapler 100 (not shown) is located in the notched portion 174. Similarly, the front portion of the left wall 106 is notched, and a driver of the stapler 100 (not shown) is located in the notched portion 175. The first guide slots 115 and 115 are formed rearward in the inner and lower portions of the right wall 105 and the left wall 106, respectively, and the second guide slots 116 and 116 are formed forward therein. The first guide slot 115 is formed higher than the second guide slot 116. A stopper piece 118 is formed in the front of the first guide slot 115 by providing a notch 117 with a shape of substantially "L".

The rear portion 120 of the bottom wall 103 is inclined, and a locking shaft 121 slightly protruding from the bottom wall 103 is provided on the upper portion of the above-described rear portion 120 in a nearly horizontal manner. As shown in FIG. 4(A) through FIG. 4(C), one end of the locking shaft 121 is slidably guided in a long hole 122 which is vertically extending, and which is formed on the left wall 106, and the other end is slidably guided in a long hole 123, which is vertically extending, and which is formed on the right wall 105.

Moreover, one end of the spring-like elastic member 126, the other end of which is fixed at a rod 125 provided at the outer side of the right wall 105, is fixed at one end of the locking shaft 121, and one end of another spring-like elastic member 126, the other end of which is fixed at another rod 125 provided at the outer side of the left wall 106, is fixed at the other end of the locking shaft 121. The locking shaft 121 is biased upward with the above elastic members 126 and 126, and both ends of the above locking shaft 121 are resting on the upper ends of the long holes 122 and 123, respectively.

Arm members 130 and 130 are rotatably provided in the inner and upper portions of the right wall 105 and the left wall 106, respectively. Rotating shafts 131 and 131 are provided above the arm members 130 and 130, respectively, and spring bearing members 132 and 132 are provided above about the intermediate portion, respectively. The arm members 130 and 130 can be rotated around the rotating shafts 131 and 131 pivoted at bearing holes 133 and 133 formed in the upper portion of the right wall 105 and the left wall 106, respectively. Moreover, one of the spring bearing members 132 and 132, which is protruded through a look-through hole 113 formed in the left wall 106, is provided on one of the arm members 130 and 130, and, similarly, the other spring bearing member 132 protruded through a look-through hole 114 formed in the right wall 105 is provided on the other arm member 130. One end of a spring-like elastic member 134 is fixed at a rod 135 provided outside the right wall 105, and the other end of the spring-like elastic member 134 is fixed at one of the above spring bearing members 132 and 132. Similarly, one end of another spring-like elastic member 134 is fixed at another rod 135 provided outside the left wall 106, and the other end of another spring-like elastic member 134 is fixed at the other spring bearing member 132. Thereby, the arm members 130 and 130 are biased downward.

A front wall 136 is formed at the front end of the bottom wall 103. A locking hole 137 is formed at about the center of the front wall 136. The guide members 138 are formed in about a horizontal manner at both sides of the rear end of the top wall 107, respectively.

The cartridge 140 comprises: a bottom plate 141; a right guide plate 142 provided at the front portion of the right end of the bottom plate 141; a right side plate 143 provided in the rear portion of the right end of the bottom plate 141; a left guide plate 145 provided at the front portion of the left end of bottom plate 141; a left side plate 146 provided in the rear portion of the left end of the bottom plate 141; a back plate 147 provided at the rear end of the bottom plate 141; and a front plate 149 provided at the front end of the bottom plate 141.

A rectangular opening 148 is formed in the front portion of the bottom plate 141. A staple driving guide 150 is provided in the front portion of the cartridge 140. The staple driving guide 150 has a pair of locking concave sections 151 and 151 which respectively lock the locking sections 48 and 49 provided in the front wall 5 of the refill 1 for staples, and a resting section 152 on which the covering member 45 provided on the front wall 5 rests.

In the cartridge 140, a locking pawl 153 is formed at about the center of the back plate 147, and a locking projection 155 is provided at the front plate 149. A guide pawl 160 is formed by a slot 156 with a shape of substantially "U" on the right side plate 143, and a guide pawl 161 is formed by a slot 157 with a shape of substantially "U" on the left side plate 146. The guide pawls 160 and 161 have horizontal walls 163 and 163 formed in the upper portion, tapered guide surfaces 166 and 166 formed in the tip portions of the above horizontal walls 163 and 163, and inclined walls 165 and 165 in the lower portion, respectively. Here, operating sections 167 and 167 are formed in the rear portions of the guide pawls 160 and 161, respectively.

The locking concave sections 170 and 170 are formed in the front portions of the lower end edge of the right side plate 143 and the left side plate 146, respectively. The locking concave section 170 comprises: a rearward inclined edge 171; and a forward inclined edge 172 which is more steeply inclined than the rearward inclined edge 171. The tip 173 of the forward inclined edge 172 is somewhat protruding from the lower end edges of the right side plate 143 and the left side plate 146.

The locking projections 180 and 180 are formed in the rear portion of the lower end edge of the right side plate 143, and in the rear portion of the lower end edge of the left side plate 146, respectively. The locking projection 180 comprises; an inclined edge 181 formed in the front portion; and a vertical edge 182 formed on the rear portion.

The cartridge 140 is provided with a door member 185 in the rear portion. The door member 185 comprises: a cover section 186; and arm sections 187 and 187 provided at each side of the cover section 186. Rotation holes 189 and 189 are formed in the tip portions of the arm portions 187 and 187, respectively. The above rotation holes 189 and 189 are rotatably installed at rods 190 and 190 formed in about the center of the right side plate 143 and the left side plate 146, respectively.

Accordingly the door member 185 can be rotated around the rods 190 and 190. The door member 185 can be rotated from a position at which the arm section 187 and 187 are engaged with engaging projections 191 and 191 formed on the right side plate 143 and the left side plate 146, respectively, to a position at which an engaging concave section 193 in the cover section 186 is engaged with an engaging piece 192 formed in the rear plate 147.

Subsequently, the use of the stapler 100 will be explained. As shown in FIG. 10(A) through FIG. 10(C), sheet-type connected staples S are laminated and held in the refill body 2 of the refill 1 for staples. The laminated sheet-type connected staples S are put on the bottom wall 3, the fore-and-aft movement of the staples is controlled by the front wall 5 and the resting projections 64 and 69 of the locking plate 9, and the transverse movement of the staples is controlled by the right 6 and the left wall 7. With regard to the pressing member 70, the tip of the guide projection 80 rests on the front wall 5, and the rear portion 74 rests on the resting projection 69 of the locking plate 9, and, similarly, the tip of the guide projection 81 rests on the front wall 5, and the rear portion 74 rests on the resting projection 64 of the locking plate 9.

A method by which the above-described refill 1 for staples is mounted on the cartridge 140 will be explained. The locking sections 48 and 49 in the refill body 2 is locked with the locking concave sections 151 and 151, respectively. In this case, the covering member 45 rests on the resting section 152, and the delivery port 41 is opened. Then, when the refill body 2 is pressed to the side of the cartridge 140, the flexible piece 65 rests on the locking pawl 153, the piece 65 is bent inward, and the flexible piece 65 recovers the original state after the locking hole 66 formed on the flexible piece 65 is engaged with the locking pawl 153. Thereby, the refill 1 for staples is fixed in the cartridge 140.

Then, a method by which the cartridge 140 mounting the above-described refill 1 for staples is mounted on the stapler body 101 will be explained.

When the cartridge 140 is pushed into the stapler body 101, the arm members 130 and 130 provided on both sides of the cartridge holding chamber 102 are engaged with each end of the guide shaft 75 in the pressing member 70, and the arm members 130 and 130 are pushed upward against the elasticity of the elastic members 134 and 134, respectively. Accordingly, the pressing member 70 is pushed downward by the arm members 130 and 130 which are biased downward by the elastic members 134 and 134, respectively, and the pressing projections 82 press the laminated sheet-type connected staples S.

Here, when the refill body 2 is not completely set in the cartridge 140, that is, even in a state in which the locking hole 66 is not locked with the locking pawl 153, the refill body 2 is pressed with the guide members 138 and 138 and goes down so as to engage the locking hole 66 with the locking pawl 153, because the right inclined edge 33 and the left inclined edge 37 of the refill body 2, the upper end edge 32 of the right wall 6, and the upper end edge 36 of the left wall 7 are guided by the guide members 138 and 138 when the cartridge 140 is pushed into the stapler body 101 as show in FIG. 10(A) through FIG. 10(C) and FIG. 11(A) through FIG. 11(C).

When the cartridge 140 is completely mounted on the cartridge holding chamber 102 of the stapler body 101, the above-described locking shaft 121 is moved downward along the inclined edges 181 and 181 of the locking projections 180 and 180. The locking shaft 121 is biased upward by the elastic members 126 and 126, and rests on the lower end edge of the cartridge 140 at any time. When the locking shaft 121 climbs over the locking projections 180 and 180, the locking shaft 121 rests on the vertical edges 182 and 182. As the direction in which the locking shaft 121 can be moved is only a vertical direction, the locking shaft 121 is not moved downward not to climb over the locking projections 180 and 180 even when the locking shaft 121 is pressed by the above-described vertical edge 182 in the direction in which the cartridge 140 is pulled out. That is, backward movement of the cartridge 140 is prevented by resting of the locking shaft 121 on the above-described vertical edge 182.

Moreover, when the cartridge 140 is pushed into the stapler body 101 as described above, the locking shaft 121 is engaged with the arm members 187 and 187 of the door member 185 to push up the arm members 187 and 187. Thereby, the door member 185 is closed, and the opening 108 of the cartridge holding chamber 102 is closed.

When the stapler 100 is driven, sheet-type connected staples S are sent out from the delivery port 41, using a sending pawl (not shown), and a top staple is driven to file sheets of paper by a driver. A forward sending pawl is engaged with the bottom of sheet-type connected staples S through the opening 148 of the bottom portion in the cartridge 140, and the look-through hole 11 of the bottom portion of the refill body, and sends out the sheet-type connected staples S.

When all sheet-type connected staples S are delivered from the inside of the refill body 2, the pressing plate 71 rests on the bottom wall 3, the guide projections 80 and 81 get out of the front wall 5, the pressing plate 71 can move forward, and rotation of the locking plate 9 becomes possible to unlock the locking pawl 153 from the locking hole 66.

As shown in FIG. 8(A) through FIG. 8(D), the arm members 187 and 187, respectively, push the locking shaft 121 downward against the elasticity of the elastic members 126 and 126, the locking shaft 121 gets out of the vertical edges 182 and 182 of the locking projections 180 and 180, and, at the same time, the cartridge 140 can be pulled out, pivoting about the locking shaft 121 (refer to FIG. 8(C)) when the door member 185 is pushed downward for opening. When the cartridge 140 is further pulled out, the locking shaft 121 is locked with the locking concave sections 170 and 170 to prevent the cartridge 140 from being pulled out.

Here, each of the locking concave sections 170 and 170 includes: a rearward inclined edge 171; and a forward inclined edge 172, and, when forcibly pulled, the locking shaft 121 climbs over the forward inclined edge 172 to pull out the cartridge 140. Thereby, the cartridge 140 never breaks even when the cartridge 140 is forcibly pulled.

The cartridge 140 can be detached from the stapler body 101 because the guide pawls 160 and 161 respectively get out of the first guide slots 115 and 115 by pushing the operating sections 167 and 167 of the guide pawls 160 and 161 to the inside in a state shown in FIG. 5(A) and FIG. 5(B), and FIG. 8(D).

The guide pawls 160 and 161 are members provided on the side surfaces of the cartridge 140, as described above. The horizontal walls 163 and 163, respectively, are provided on the upper ends of the guide pawls 160 and 161, a part of the above horizontal wall 163 is formed, protruding outward from one side surface of the cartridge 140, and a part of another horizontal wall 163 is formed, protruding outward from the other side surface of the cartridge 140. Moreover, the tapered guide surfaces 166 and 166 are formed in the tip portions of the horizontal walls 163 and 163, respectively. Upward movement of the cartridge 140 is limited by engaging the above horizontal wall 163 with the upper end edge of the guide slots 115 and 115 of the stapler body 101.

Inclined surfaces (inclined walls 165 and 165) which are inclined at an angle from the projected portions are provided in the lower portion of the above-described horizontal walls 163 and 163, respectively. The above-described guide surface 166 and the above-described inclined surface 165 have a function by which the guide pawl 160 is bent inward by resting on the right wall 105 of the stapler body 101, and the guide pawl 161 is bent inward by resting on the left wall 106 of the stapler body 101 when the cartridge 140 is mounted on the stapler body 101.

The cartridge 140 is mounted on the stapler body 101 by sliding and pushing the lower end of the front plate 149 onto the bottom wall 103 in the cartridge holding chamber 102. In this case, the guide pawls 160 and 161 are bent inward by sliding the inclined walls 165 and 165, and the guide surfaces 166 and 166 of the guide pawls 160 and 161 on the inner edge of the right wall 105 and the left walls 106, respectively. Subsequently, the protruding portions of the horizontal walls 163 and 163, respectively, are engaged with the slot portions of the guide walls 115 and 115 after the guide pawl 160 and 161 are bent inward. Thus, once the guide pawls 160 and 161 have been bent, the cartridge 140 can be slid into the stapler body 101 in engagement with the guide slots 115. Moreover, at about the same time the cartridge 140 is mounted on the stapler body 101, the locking concave sections 170 and 170 are engaged with the locking shaft 121 (refer to FIG. 5(A) and FIG. 5(B), and FIG. 8(D)).

When the cartridge 140 is pushed forward, the guide pawls 160 and 161 are guided in the first guide slots 115 and 115, respectively, and, furthermore, the right guide plate 142 and the left guide plate 145 of the tip portion of the cartridge 140 are slidably guided in the second guide slots 116 and 116 of the stapler body 101, respectively. Moreover, the locking projection 155 of the cartridge 140 is locked with the locking hole 137 of the front wall 136 in the stapler body 101 to fix the front portion. At about the same time, the locking shaft 121 is engaged with the vertical edges 182 and 182 of the locking projections 180 and 180, and contacts with the cartridge 140 so that the lower end of the cartridge 140 is pushed upward. Thereby, the rear portion of the cartridge 140 is fixed, and, as shown in FIG. 4(A) through FIG. 4(C), the cartridge 140 is installed in the stapler body 101 in a stable manner without wobbling.

ADVANTAGES OF THE INVENTION

As explained above, the stapler according to the present invention comprises: the stapler body; and the cartridge which is mounted on the cartridge holding chamber of the stapler body in such a way that the cartridge can be pulled out from the chamber, and the locking shaft biased upward by the elastic member is provided in the lower portion of the opening in the cartridge holding chamber. Moreover, the cartridge has the locking projection and the door member, and, when the cartridge is mounted on the cartridge holding chamber, the above-described locking projection is locked with the above-described locking shaft, and the above-described door member is biased in such a way that the opening of the cartridge holding chamber is closed by the above-described locking shaft. When the door member closing the opening of the cartridge holding chamber is opened, the above-described locking shaft is gotten out of the locking projection by the door member. Thereby, the cartridge is mounted on the stapler body in a stable manner without wobbling, and fixing of the cartridge can be released in synchronization with opening operation of the door member. Furthermore, a complex configuration is not required, and cheap manufacturing can be realized. Moreover, as the refill for staples can be exchanged by pulling out the cartridge from the stapler body, dropping of the cartridge is prevented, and the exchanging operation can be performed with a single hand.

The stapler according to the present invention has an advantage that the cartridge can not be easily removed from the stapler body because the locking section, which is locked with the above-described locking shaft when the cartridge is pulled out from the cartridge holding chamber of the stapler body, is formed in the cartridge.

The stapler according to the present invention has another advantage that the cartridge provided in such a way that the cartridge can be pulled out from the cartridge holding chamber by getting the guide pawls out of the above-described guide slots can be easily detached from the stapler body, and the cartridge itself can be exchanged because the guide slots are formed at both sides of the cartridge holding chamber, and the guide pawls guided in the above-described slots are provided at both sides of the cartridge.

The stapler according to the present invention has further another advantage that the refill for staples can be automatically accommodated in the cartridge, using the guide members, when the cartridge is pushed into the stapler body, and the refill for staples can be prevented from poor setting because the stapler comprises: the stapler body; and the cartridge which is mounted on the cartridge holding chamber of the stapler body in such a way that the cartridge can be pulled out from the chamber, and the guide members, by which the refill for staples held in the cartridge is guided in the direction in which the cartridge is mounted, are formed in the upper portion of the cartridge holding chamber.

DESCRIPTION OF REFERENCE NUMERALS

| [Description of reference numerals] | |
|---|---|
| S | sheet-type connected staples |
| 1 | refill for staples |
| 2 | refill body |
| 3 | bottom wall |
| 5 | front wall |
| 6 | right wall |
| 7 | left wall |
| 9 | locking plate |
| 11 | look-through hole |
| 12 | notch |
| 18 | projection for backward-motion prevention |
| 19 | projection for backward-motion prevention |
| 20 | guide slot |
| 21 | guide slot |
| 22 | concave portion |
| 23 | concave portion |
| 24 | concave portion |
| 25 | concave portion |
| 26 | small projection |
| 27 | small projection |
| 31 | front end edge |
| 32 | upper end edge |
| 33 | right inclined edge |
| 35 | front end edge |
| 36 | upper end edge |
| 37 | left inclined edge |
| 41 | delivery port |
| 45 | covering member |
| 48 | locking section |
| 49 | locking section |
| 52 | bearing plate |
| 53 | bearing plate |
| 62 | slot |
| 63 | slot |
| 64 | resting projection |
| 65 | flexible piece |
| 66 | locking hole |
| 69 | resting projection |
| 70 | pressing member |
| 71 | pressing plate |
| 72 | reinforcing wall |
| 73 | reinforcing wall |
| 75 | guide shaft |
| 76 | locking piece |
| 80 | guide projection |
| 81 | guide projection |
| 82 | pressing projection |
| 86 | locking shoulder section |
| 100 | stapler |
| 101 | stapler body |
| 102 | cartridge holding chamber |
| 103 | bottom wall |
| 105 | right wall |
| 106 | left wall |
| 107 | top wall |
| 108 | opening |
| 109 | inclined edge |
| 110 | inclined edge |
| 111 | vertical edge |
| 112 | vertical edge |
| 113 | look-through hole |
| 115 | first guide slot |
| 116 | second guide slot |
| 117 | notch |
| 118 | stopper piece |
| 120 | rear portion |
| 121 | locking shaft |
| 122 | long hole |
| 123 | long hole |
| 125 | rod |

-continued

| [Description of reference numerals] | |
|---|---|
| 126 | elastic member |
| 130 | arm member |
| 131 | rotating shaft |
| 132 | spring bearing member |
| 133 | bearing hole |
| 134 | elastic member |
| 135 | rod |
| 136 | front wall |
| 137 | locking hole |
| 138 | guide member |
| 140 | cartridge |
| 141 | bottom plate |
| 142 | right guide plate |
| 143 | right side plate |
| 145 | left guide plate |
| 146 | left side plate |
| 147 | back plate |
| 148 | opening |
| 149 | front plate |
| 150 | staple driving guide |
| 151 | locking concave section |
| 152 | resting section |
| 153 | locking pawl |
| 155 | locking projection |
| 156 | slot |
| 157 | slot |
| 160 | guide pawl |
| 161 | guide pawl |
| 163 | horizontal wall |
| 165 | inclined wall |
| 167 | operating section |
| 170 | locking concave section |
| 171 | rearward inclined edge |
| 172 | forward inclined edge |
| 173 | tip |
| 174 | notched portion |
| 175 | notched portion |
| 180 | locking projection |
| 181 | inclined edge |
| 182 | vertical edge |
| 185 | door member |
| 186 | cover section |
| 187 | arm portion |
| 189 | rotation hole |
| 190 | rod |
| 191 | engaging projection |
| 192 | engaging piece |
| 193 | engaging concave section |

INDUSTRIAL APPLICABILITY

The present invention can be applicable for an electric stapler provided in a copying machine, a printing machine and the like.

The invention claimed is:

1. A stapler, comprising:

a stapler body and a cartridge mounted on a cartridge holding chamber of the stapler body to be able to pull out;

a locking shaft provided on the lower portion of an opening of the cartridge holding chamber, biased upward by an elastic member;

wherein the cartridge has a locking projection and a door member;

wherein the locking projection engages with said locking shaft when the cartridge is mounted on the cartridge holding chamber;

wherein the door member is biased by the locking shaft to close the opening of the cartridge holding chamber; and, wherein the door member disengages the locking shaft from the locking projection when the door member closing the opening of said cartridge holding chamber is opened.

2. The stapler according to claim 1, wherein the cartridge is provided with a locking section locked with the locking shaft when the cartridge is pulled out of the cartridge holding chamber of the stapler body.

3. The stapler according to claim 1, wherein guide slots are formed on both sides of the cartridge holding chamber, and guide pawls are formed on both sides of the cartridge to be guided by the guide slots; wherein the cartridge is detachable from the stapler body by disengaging the guide pawls from the guide slots.

4. The stapler according to claim 1, further comprising:

guide members formed at an upper portion of the cartridge holding chamber for guiding a refill for staples held in the cartridge in the direction to mount the cartridge.

5. The stapler according to claim 2, wherein guide slots are formed on both sides of the cartridge holding chamber, and guide pawls are formed on both sides of the cartridge to be guided by the guide slots; wherein the cartridge is detachable from the stapler body by disengaging the guide pawls from the guide slots.

* * * * *